US005480754A

United States Patent [19]

Takei et al.

[11] Patent Number: 5,480,754

[45] Date of Patent: Jan. 2, 1996

[54] ELECTROPHOTOGRAPHIC PHOTOSENSITIVE MEMBER AND METHOD OF MANUFACTURING THE SAME

[75] Inventors: Tetsuya Takei, Nagahama; Yoshio Segi, Nara; Hiroyuki Katagiri, Tsuzuki, all of Japan

[73] Assignee: Canon Kabushiki Kaisha, Tokyo, Japan

[21] Appl. No.: 215,644

[22] Filed: Mar. 22, 1994

[30] Foreign Application Priority Data

Mar. 23, 1993 [JP] Japan ..... 5-086872

[51] Int. Cl.[6] ..... G03G 5/10

[52] U.S. Cl. ..... 430/65; 430/131

[58] Field of Search ..... 430/128, 127, 430/65, 131

[56] References Cited

U.S. PATENT DOCUMENTS

| | | | |
|---|---|---|---|
| 4,504,518 | 3/1985 | Ovshinsky et al. | 427/38 |
| 5,170,683 | 12/1992 | Kawada et al. | 407/11 |
| 5,314,780 | 5/1994 | Takei et al. | 430/128 |

FOREIGN PATENT DOCUMENTS

| | | | |
|---|---|---|---|
| 54-86341 | 7/1979 | Japan | G03G 5/08 |
| 58-14841 | 1/1983 | Japan | G03G 5/10 |
| 59-193463 | 11/1984 | Japan | G03G 5/10 |
| 60-876 | 1/1985 | Japan | C02F 1/00 |
| 60-186849 | 9/1985 | Japan | G03G 5/082 |
| 60-262936 | 12/1985 | Japan | C22C 21/06 |
| 61-171798 | 8/1986 | Japan | C10M 111/04 |
| 61-273551 | 12/1986 | Japan | G03G 5/082 |
| 61-283116 | 12/1986 | Japan | H01L 21/205 |
| 63-264764 | 11/1988 | Japan | G03G 5/10 |
| 1-130159 | 5/1989 | Japan | G03G 5/00 |

*Primary Examiner*—John Goodrow

*Attorney, Agent, or Firm*—Fitzpatrick, Cella, Harper & Scinto

[57] ABSTRACT

A method for manufacturing an electrophotographic photosensitive member capable of providing high quality even images, which are completely free from image defects and unevenness of image density, which comprises a step for forming a non-monocrystalline deposited film comprising silicon atoms and hydrogen atoms and/or fluorine atoms on an aluminum substrate containing a fine quantity of silicon atoms by a plasma CVD method, wherein the surface of the substrate is cleaned with water in which carbon dioxide has been dissolved before a process for forming the deposited film.

92 Claims, 7 Drawing Sheets

ELECTROPHOTOGRAPHIC PHOTOSENSITIVE MEMBER AND METHOD OF MANUFACTURING THE SAME

BACKGROUND OF THE INVENTION

1. Field of the Invention

The present invention relates to a method of manufacturing an electrophotographic photosensitive member which comprises a functional film formed on an aluminum substrate and, more particularly, to an electrophotographic photosensitive member which is made up by forming a non-monocrystalline deposited film comprising silicon atoms and hydrogen atoms on an aluminum substrate comprising a silicon element as a functional film according to a plasma CVD method and a method of manufacturing the member.

2. Related Background Art

Glass, heat-resistant synthetic resin, stainless steel, and aluminum have been proposed as substrates for forming deposited films of electrophotographic photosensitive members. Actually, however, metals have often been used for their durability to electrophotographic processes such as charging, exposure, development, transfer and cleaning and for maintaining high positional accuracy at all times without deterioration of an image quality. Particularly, aluminum is one of most suitable materials for substrates of electrophotographic photosensitive members for its excellent workability, low cost and light weight.

A technique regarding those materials for the substrates of the electrophotographic photosensitive member is described in Japanese Patent Application Laid-open No. 59-193463 and Japanese Patent Application Laid-open No. 60-262936. Japanese Patent Application Laid-open No. 59-193463 has disclosed a technique for obtaining amorphous silicon electrophotographic photosensitive members which provide a high image quality by forming supports with aluminum alloys which have a Fe content of 2000 ppm or less. In addition, this laid-open application has disclosed a procedure for forming amorphous silicon by glow discharging after cutting a cylindrical (or cylinder-like) substrate by means of a lathe and mirror-finishing its surface. Japanese Patent Application Laid-open No. 60-262936 has disclosed an extrusion-molded amorphous silicon aluminum alloy, comprising Mg of 3.0 to 6.0 weight % and Mn of not more than 0.3 weight %, Cr of less than 0.01 weight %, Fe of not more than 0.15 weight % and Si of not more than 0.12 weight % as additive impurities, and the remainder comprising aluminum, which excels in depositability. However, these laid-open applications do not disclose a cleaning method with water containing specific substances.

Japanese Patent Application Laid-open No. 61-171798 has disclosed a technique regarding a method of working substrates for electrophotographic photosensitive members. This laid-open application has disclosed a technique for obtaining an electrophotographic photosensitive member made of high quality amorphous silicon or the like by cutting a substrate with a cutting oil of specific contents. This laid-open application has also disclosed that the substrate is cleaned with triethane (trichloroethane: $C_2H_3Cl_3$) after cutting.

Techniques regarding surface treatments of substrates of electrophotographic photosensitive members have been proposed in Japanese Patent Application Laid-open Nos. 58-014841, 61-273551, 63-264764 and 1-130159.

Japanese Patent Application Laid-open No. 58-014841 has disclosed a technique for obtaining a uniform oxide film by removing a natural oxide film on a surface of an aluminum support and immersing it into water with a temperature of not less than 60° C.

Japanese Patent Application Laid-open No. 61-273551 has disclosed a technique including alkali cleaning, trichloroethylene cleaning and ultraviolet ray irradiation cleaning with a mercury lamp, as pretreatments of substrates, for forming an electrophotographic photosensitive member by depositing Se or the like on an aluminum substrate and has also disclosed cleaning with degreasing liquid, steam and purified water to remove oil and fat remaining on the surfaces of cylindrical aluminum substrate, as a pretreatment for ultraviolet ray irradiation cleaning.

Japanese Patent Application Laid-open No. 63-264764 has disclosed a technique for roughing the surface of substrate with a water jet.

Japanese Patent Application Laid-open No. 1-130159 has disclosed a technique for cleaning a electrophotographic photosensitive support with a water jet. Though this laid-open application has disclosed amorphous silicon simultaneously with Se and organic photoconductive materials as an example of the photosensitive member, no problems inherent to the plasma CVD method have been discussed.

On the other hand, Japanese Patent Application Laid-open No. 60-876 has disclosed a technique for blowing carbon dioxide into super purified water as a pretreatment for substrates other than electrophotographic photosensitive members to prevent damage due to static discharge on wafers. However, this technique provides an antistatic measure against static electricity produced on substrates with a high resistance as wafers and is not described for use conductive substrates such as of aluminum.

Various types of materials including selenium, cadmium sulfide, zinc oxide, amorphous silicon and organic substances such as phthalocyanine have been proposed as the materials for the electrophotographic photosensitive members. Particularly, nonmonocrystalline deposited films containing silicon atoms as the main component which are represented by amorphous silicon, for example, amorphous deposited films of amorphous silicon or the like compensated with hydrogen and/or halogen (for example, fluorine, chlorine or the like) have been proposed as pollution and contamination-free photosensitive members with high performance and durability. Some of them have been practically used. Japanese Patent Application Laid-open No. 54-86341 has disclosed a technique for electrophotographic photosensitive members the photoconductive layer of which is mainly formed with amorphous silicon.

A number of methods such as a sputtering method, a thermal starting gas decomposing method (thermal CVD method), an optical starting gas decomposing method (optical CVD method) and a plasma starting gas decomposing method (plasma CVD method) are known as methods for forming non-monocrystalline deposited films comprising silicon atoms as the main component.

The plasma CVD method, that is, a method for forming a thin deposited film on the substrate by decomposing the starting gas with a direct current, a high frequency or a microwave glow discharge, is best suited for formation of an amorphous silicon deposited film for electronic photography and practical application of this method has been substantially promoted. Particularly, lately, the plasma CVD method using decomposition by microwave glow discharging, that is, a microwave plasma CVD method has been industrially noted as the deposited film forming method.

The microwave plasma CVD method provides the advantages such as high deposition rate and high efficiency in use of the starting gas as compared with other methods. An example of microwave plasma CVD techniques which provide such advantages has been disclosed in U.S. Pat. No. 4,504,518. The technique disclosed in this patent is intended to obtain high quality deposited films at a high deposition rate at a low pressure of not higher than 0.1 Torr by the microwave plasma CVD method.

In addition, a technique for improving the efficiency of use of the starting gas by the microwave plasma CVD method has been disclosed in Japan Patent Application Laid-open No. 60-186849. The technique disclosed in this laid-open application is briefly intended to arrange a substrate so that it surrounds microwave energy introducing means and form an internal chamber (i.e. a discharging space), thereby substantially improving the efficiency of use of the starting gas.

Japanese Patent Application Laid-open No. 61-283116 has disclosed an improved microwave technique for making semiconductor members. In other words, this laid-open application has disclosed a technique which is intended to provide an electrode (bias electrode) for controlling a plasma potential in the discharging space, by applying a required voltage (bias voltage) and carrying out deposition of a film while controlling an ion impact to a deposited film, thus improving the characteristics of the deposited film.

When a cylinder made of an aluminum alloy is used as a substrate, the methods for making the electrophotographic photosensitive members according to the prior art are typically executed as described below.

A diamond cutting tool (trade name: MIRACLE BITE manufactured by Tokyo Diamond K.K.) is set on a lathe provided with an air damper for precision cutting (manufactured by PNEUMO PRECISION INC.) so as to obtain a relief angle of 5° in reference to the central angle of the cylinder. Then the substrate is vacuum-chucked to the rotary flange of this lathe and mirror-finished at a peripheral speed of 1000 m/min. and a feed rate of 0.01 mm/R so as to obtain an outside diameter of 108 mm while spraying white kerosene from attached nozzles and removing used white kerosene which contains chip through attached vacuum nozzles.

Then each cut substrate is cleaned with trichloroethane to clear off cutting oil and chips remaining on its surface.

Each substrate is mirror-finished and cleaned, and a deposited film mainly comprising amorphous silicon is formed on the cleaned substrate by the deposited film forming apparatus for photoconductive members which uses a glow discharge decomposition method shown in FIG. 1.

In FIG. 1, a reactor 301 is formed by a base plate 302, a wall 303 and a top plate 304, wherein a cathode electrode 305 is provided and a substrate 306 on which an amorphous silicon deposited film is formed is arranged at the center of the cathode 305 to play a role of an anode.

For depositing the amorphous silicon film using this deposited film forming apparatus on the substrate 306, a starting gas inlet valve 307 and a leak valve 308 are closed, and exhaust valve 309 is opened to evacuate the reactor 301. The starting gas such as, for example, $SiH_4$ gas, which has been adjusted to a predetermined mixing ratio in a mass flow controller 311, is introduced into the reactor 301 by opening the starting gas inlet valve 307 when a vacuum indicator 310 reads approximately $5\times10^{-6}$ Torr. After it has been ascertained that a surface temperature of the substrate 306 is set at a predetermined temperature by a heater 312, a high frequency power supply 313 is set to a predetermined power level to cause glow discharging in the reactor 301.

While formation of a deposited film is being carried out, the substrate 306 is rotated by a motor 314 at a fixed speed in order to uniformly form the deposited film. Thus the amorphous silicon deposited film can be formed on the substrate 306.

However, in the conventional methods for making electrophotographic photosensitive members, there still remains a problem to be solved in that it is difficult to obtain, at a stable and high yield rate, deposited films capable of providing uniform qualities, satisfying optical and electrical characteristics and having high image qualities in formation of images by an electrophotographic process, particularly in an area where a depositing rate for forming the deposited film is high.

Specifically, a conventional electrophotographic photosensitive member includes a portion of abnormal deposition on which a surface charge of a micro area cannot be loaded. This phenomenon is especially observed on an electrophotographic photosensitive member prepared by the deposited film formed by the plasma CVD method such as amorphous silicon. However, such portion where a surface potential is unavailable can be minimized by optimizing the surface working conditions and the depositing conditions for the substrates. In the case of the prior art, such portions have been smaller than the resolution in development and therefore no problem has occurred in this point.

In recent years, however, the following situations have been noted.

1) High quality of images obtained by the electrophotographic apparatus has been demanded and accordingly the resolution of development has been improved.

2) Increasing of operating speeds of copiers has been promoted and charging conditions have been intensified to be more strict, and therefore those portions where the surface potential is unavailable have exhibited a substantial effect on the peripheral potential.

Under the situation as described above, these micro portions on which a charge cannot be loaded have been pointed out as a defect of the image though they have not been considered a problem.

In addition, since conventional copying applications have been mainly for the originals containing only characters (so-called line copies), these image defects have not actually been considered a serious problem. However, along with improvement of the qualities of copies made by the lately manufactured copiers, those scripts including half tone pictures such as photographs have increased to cause a problem. Particularly, these defects are visually clear in the color copiers which have widely been employed in recent years and are becoming a serious problem.

These changes are extremely small and cannot therefore be detected even though an electrode is provided at the upper part to measure the conductivity. However, when charging, exposure and development are carried out by the electrophotographic process for electrophotographic photosensitive members, particularly when a uniform image is formed in the half tone, even a slight difference of potential on the surface of the electrophotographic photosensitive members appears as visually remarkable defects. In particular, the above problem is more conspicuous in electrophotographic photosensitive members made by the microwave plasma CVD method.

On the other hand, such image defect will be particularly conspicuous on the electrophotographic photosensitive members made by the plasma CVD method as compared with the Se electrophotographic photosensitive members made by vacuum deposition and the OPC electrophotographic photosensitive members made by a blade application method or a dipping method.

In the case of the devices similarly made by the plasma CVD method, the difference of characteristics depending on the position on the substrate does not affect their performances as in solar cells, or the above described problem does not occur on the device which can be repaired by post treatment.

SUMMARY OF THE INVENTION

An object of the present invention made to solve the above-described problems in the conventional method for making electrophotographic photosensitive members is to provide a method for making electrophotographic photosensitive members which can be stably formed at high speed and yield rate and easily used.

Another object of the present invention is to provide electrophotographic photosensitive members and a method thereof capable of solving a problem as to occurrence of image defects particularly remarkable in the plasma CVD method and obtaining uniform high quality images.

A further another object of the present invention is to provide a method for making electrophotographic photosensitive members which comprises a step for cleaning a surface of a substrate with water in which carbon dioxide is dissolved prior to a step for forming a functional film on an aluminum substrate.

A further another object of the present invention is to provide electrophotographic photosensitive members, each having a functional film on an aluminum substrate the surface of which is cleaned with water in which carbon dioxide is dissolved.

DETAILED DESCRIPTION OF THE PREFERRED EMBODIMENTS

Figure 1:
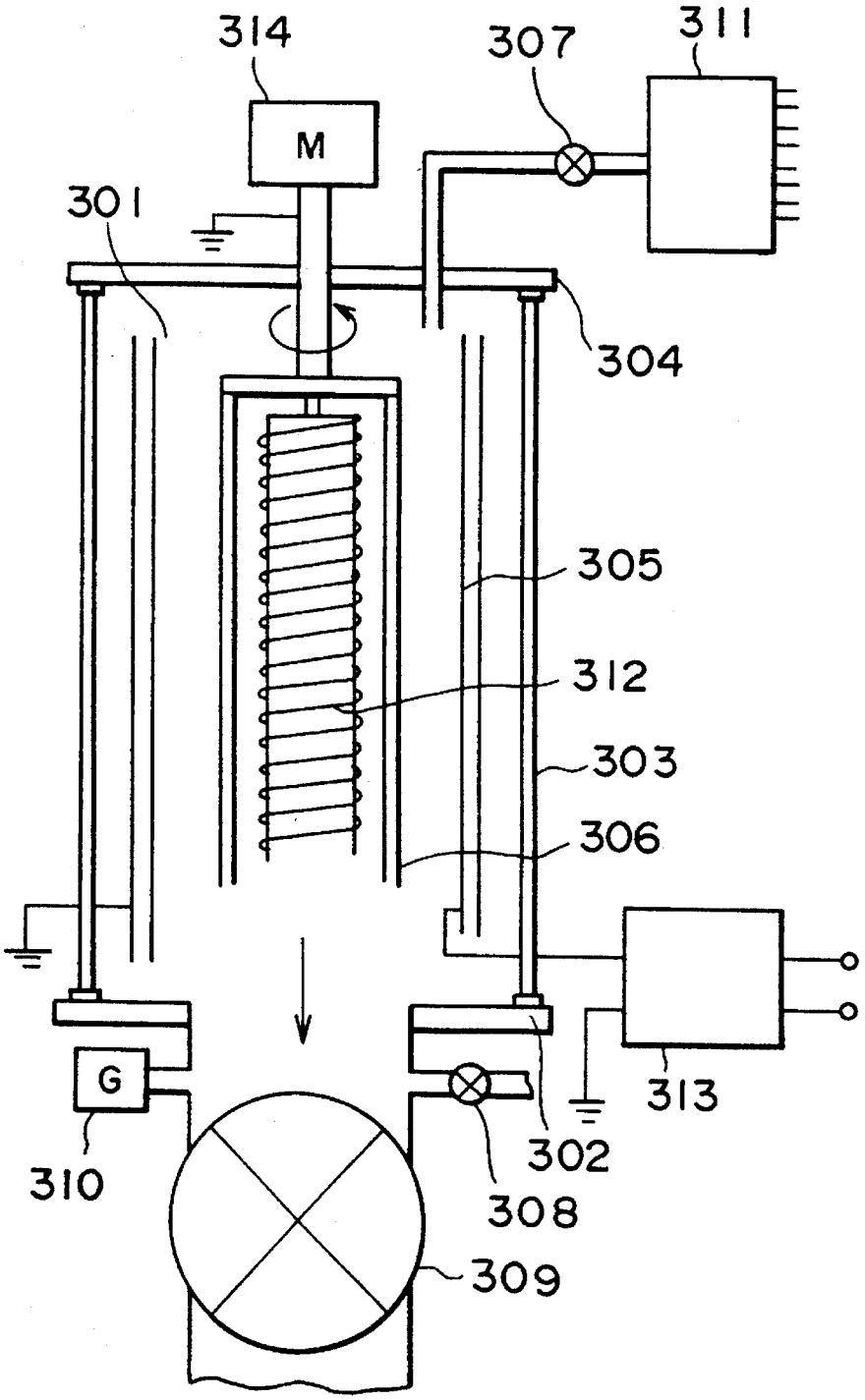
FIG. 1 is a schematic vertical sectional view of a deposited film forming apparatus for forming a deposited film on a cylindrical substrate by an RF plasma CVD method.

In the examination by the inventors, causes of image defects which occur when an aluminum substrate is used can be primarily classified as shown below:

(A) Dust or the like remaining on the substrate acts as a nucleus of an image defect.

(B) A surface defect of the substrate acts as a nucleus of an image defect.

Adhesion of dust or the like in (A) can be prevented by keeping the places for cutting and cleaning where the substrates are handled clean, strictly cleaning an interior of a film forming oven and cleaning the surfaces of substrates shortly before formation of the deposited film. The purpose of such cleaning has been achieved by cleaning the substrates with a chlorine-based solvent such as trichloroethane. However, since the use of chlorine-based solvents has been limited for the reason of destruction of the ozone layer of the earth in recent years, it is necessary to carefully examine this problem.

On the other hand, it has been extremely difficult to reduce the image defect in (B).

The inventors of the present invention have completed the present invention as a result of various studies and examinations from the standpoint for ascertaining a possibility of elimination of these problems by combining aluminum containing specific components and a specific cleaning method.

From the examination by the inventors of the present invention, it was clarified that the cause of (B) is that aluminum material locally includes extremely hard portions and these portions are gouged out by a cutter of a working machine in surface machining such as cutting as a pretreatment prior to formation of the deposited film and consequently surface defects are formed on the aluminum substrate.

In addition, the quantities of impurities to be generally contained in aluminum should be reduced to prevent these above-described phenomena. In the case of extremely high purity aluminum, however, an oxide, which is inevitably produced in melting of starting material aluminum for forming into the shape of substrate, grows to be a cause of the defect described above. It is clarified that it is effective to add silicon atoms to aluminum to prevent the above defect.

For cleaning the substrates with a chlorine-based solvent such as trichloroethane or the like after machining the substrate surfaces, the image defects due to the surface characteristic of the substrate can be fully eliminated only by such cleaning method.

Recently, however, such chlorine-based solvents cannot be easily used for environmental conservation and therefore the inventors of the present invention examined the problem of cleaning. Consequently, the inventors found that aluminum would be corroded with water, particularly, when aluminum containing silicon atoms is immersed in water during cleaning, corrosion due to water would remarkably develop mainly at a portion where silicon atoms locally concentrate.

This phenomenon is more remarkable as the temperature of water is higher and further more remarkable for aluminum containing magnesium as well as silicon atoms for improving cutting efficiency. Though various types of anti-corrosive agents have been proposed to prevent corrosion of aluminum, these anti-corrosive agents are insufficient in the preventive effect when they are used for the aluminum substrate containing silicon which is used as the substrate for the electrophotographic photosensitive member since even a slight defect which has been formed on a substrate with a large area will be a problem, and an extremely small amount of the anti-corrosive agent will remain on the substrate surface and adversely affect the electrophotographic characteristics after the deposited film is formed. If the components other than those which quickly evaporate together with water remain on the surface of the aluminum substrate, such adverse effects as abnormal spots appear on the image when the electrophotographic photosensitive member is made and therefore the used of these conventional anti-corrosive agents is limited.

The inventors of the present invention have reached the completion of the present invention as a result of their earnest studies with an emphasis on prevention of the above described defects by treating, in some manner, water to be used for cleaning the substrates to remove dust before forming the deposited film.

Many points of the mechanism of the present invention have yet remained unclear and the thought of the inventors is as follows.

A portion of the aluminum surface where there are many silicon atoms which are partly exposed forms a local battery in conjunction with the surroundings to accelerate corrosion.

On the other hand, carbon dioxide dissolved in water is changed to carbonate ion, which is attracted to the local battery to cover it and prevent the approach of oxygen in water, thus effectively preventing corrosion. In addition, carbonate ion somewhat denatures the surface including much silicon atoms to prevent abnormal growth of the deposited film from that portion when the film is formed.

In addition, unexpected effects of the present invention include reduction of uneven images and improvement of the electrophotographic photosensitive characteristics.

For forming, for example, an amorphous silicon deposited film on the substrate by the plasma CVD method, the reaction can be expected in three steps, that is, a step for decomposing the starting gas in a gaseous phase, a step for transporting active species from a discharging space to the substrate surface and a surface reaction step for reaction on the substrate surface. Particularly, the surface reaction step assumes an important role in determination of the structure of the completed deposited film. And the surface reaction is substantially affected by the temperature, materials, shape and suction substances of the substrate surface.

Particularly on an aluminum substrate of high purity, water absorption on the substrate surface, under the condition that the substrate surface has been only cleaned with a nonaqueous solvent such as trichloroethane after cutting, partly differs in that the substrate surface has been only cleaned with a purified water jet without other cleaning methods after cutting. If a deposited layer such as an amorphous silicon film containing silicon atoms, hydrogen atoms and/or fluorine atoms is formed on the substrate in such a state by, for example, the plasma CVD method, the reaction of the surface is substantially affected by the quantity of water molecules remaining on the substrate surface. This results in a change in the composition and structure of the deposited film at the interface of the deposited film in accordance with the amount of water absorption at a position of the substrate, and consequently a mode of charging from the substrate at that part changes during the process of electrophotography and a difference in the surface potential which is large enough to cause a change in image density is brought about.

The present invention enables one to effectively make the substrate surface uniform by cleaning the substrate surface with water in which carbon dioxide is dissolved before forming the deposited film by the plasma CVD method, thus succeeding in eliminating of the above-described unevenness of the image density.

In addition, carbonate ion slightly and uniformly dissolves the overall aluminum surface to raise its surface activity and aids in forming an interface which permits satisfactory exchange of charge where the deposited film is formed. Therefore the characteristics of electrophotography such as improvement of charging and reduction of residual potential can be improved.

The present invention provides a novel surface treatment method for improving defects of images which may occur in making electrophotographic photosensitive members and further the characteristics of electrophotography and has achieved a quite different effect from simple cleaning off of contaminants of the surface.

In addition, the present invention enhances the above-described effect by providing a pre-cleaning step for completely removing oil and halogenous residuals which may hinder the effect of the present invention before the cleaning step with water containing dissolved carbon dioxide after a cutting step. Particularly, the precleaning step enables to raise the effect of the present invention to the maximum level through ultrasonic cleaning in water or water to which a surface active agent is added.

Examples of Steps of Manufacturing Method

An example of a procedure for actually forming an electrophotographic photosensitive member according to the manufacturing method of an electrophotographic photosensitive member of the present invention by using a cylinder made of aluminum alloy as the substrate is described below, referring to an example of the substrate pretreatment apparatus according to the present invention shown in FIG. 2 and an example of the deposited film forming apparatus shown in FIGS. 3A and 3B.

A diamond cutting tool (trade name: MIRACLE BITE manufactured by Tokyo Diamond K.K.) is set on a lathe provided with an air damper for precision cutting (manufactured by PNEUMO PRECISION INC.) so as to obtain a relief angle of 5° in reference to the central angle of the cylinder. Then the substrate is vacuum-chucked to the rotary flange of this lathe and mirror-finished at a peripheral speed of 1000 m/min. and a feed rate of 0.01 mm/R so as to obtain an outside diameter of 108 mm while spraying white kerosene from attached nozzles and removing used white kerosene which contains chip through attached vacuum nozzles.

The surface of a substrate for which cutting has been finished is treated by the substrate pretreatment apparatus. The-substrate pretreatment apparatus of FIG. 2 has a treatment zone 102 and a substrate transport mechanism 103. The treatment zone 102 has a substrate feed stand 111, a substrate precleaning bath 121, a water treatment bath 131 using water containing dissolved carbon dioxide, a drying bath 141 and a substrate carry-out stand 151. Both the precleaning bath 121 and the water treatment bath 131 using water in which carbon dioxide is dissolved are respectively provided with a thermostat (not shown) for maintaining the liquid at a fixed temperature. Though the thermostat is always required, it is preferably provided for stable treatment. The substrate transport mechanism 103 has transport rails 165 and transport arm 161 and the transport arm has a moving mechanism 162 which moves on the rails 165, a chucking mechanism 163 for holding the substrate 101 and an air cylinder 164 for vertically moving the chucking mechanism 163.

After cutting, the substrate 101 set on the substrate feed stand 111 is transported to the substrate precleaning bath 121 by the substrate transport mechanism 103. Cutting oil and chips adhering to the substrate surface are cleaned off by ultrasonic treatment in aqueous solution 122 containing surface active agent 122 in the substrate precleaning bath 121.

The substrate 101 is transported to the cleaning bath 131 using water in which carbon dioxide is dissolved by the substrate transport mechanism 103 and is further cleaned with water which is kept at 25° C. and contains dissolved carbon dioxide. Conductivity of water containing dissolved carbon dioxide is measured with an industrial conductivity meter (trade name: α900 R/C manufactured by Horiba Seisakusho Co., Ltd.) and controlled to be maintained at approximately 10 μS/cm by dissolving carbon dioxide as required. The substrate 101 which has been cleaned with water containing dissolved carbon dioxide is transported to the drying bath 141 by the substrate transport mechanism 103 and dried with a blow of hot high pressure air from the nozzle 142.

The substrate 101 dried in the drying step is transported to the substrate carry-out stand 151 by the transport mechanism 103.

Figure 3A:
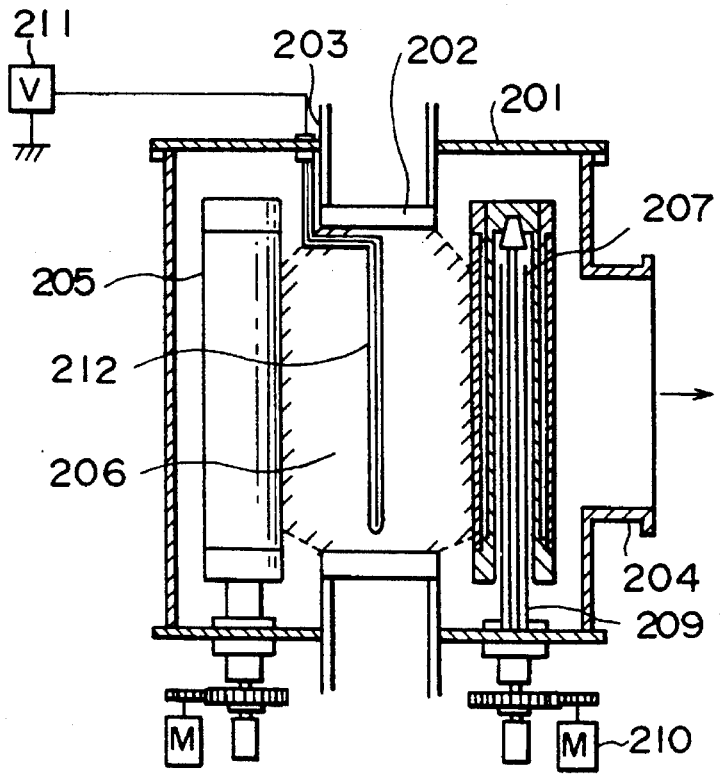
FIG. 3A is a schematic vertical sectional view of a deposited film forming apparatus for forming a deposited film on a cylindrical substrate according to a microwave plasma CVD method.
Figure 3B:
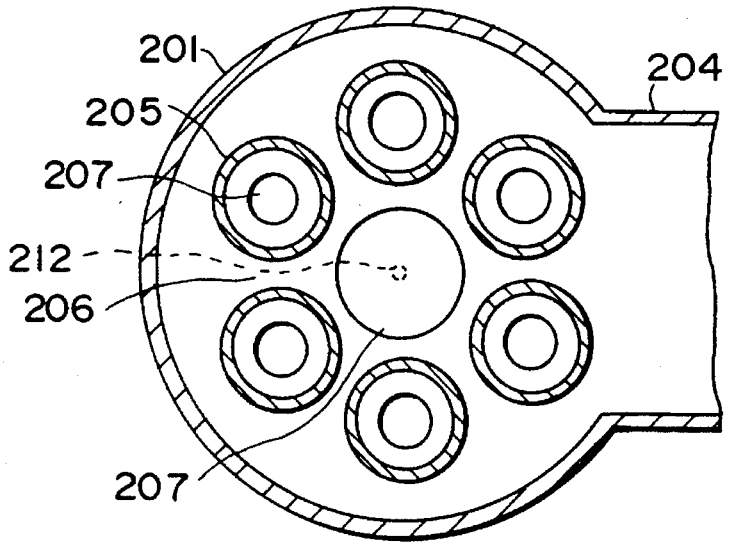
FIG. 3B is a schematic transverse sectional view of FIG. 3A.

A deposited film mainly comprising amorphous silicon is formed on the substrate for which cutting work and pretreatment have been finished by the deposited film forming apparatus for forming a deposited film comprising a photoconductive member according to the plasma CVD method shown in FIGS. 3A and 3B.

In FIGS. 3A and 3B, numerals 201 denote a reactor which has an airtight structure. 202 is a microwave guide dielectric window which is formed with a material (for example, quartz glass, alumina ceramics or the like) which efficiently admits the microwave power and is able to maintain vacuum tightness. 203 is a waveguide for transmitting the microwave power and comprises a square part from the microwave power source to nearby the reactor and a cylindrical part inserted into the reactor. The waveguide 203 is connected together with a stub tuner (not shown) and an isolator (not shown) to the microwave power source (not shown). The dielectric window 202 is air-tightly sealed to a cylindrical partial internal wall of the waveguide 203 to maintain an atmosphere in the reactor. 204 is an exhaust pipe which is open to the reactor 201 at its one end and connected to an air discharging apparatus (not shown) at its other end. 206 is a discharging space surrounded by the substrate 205. The power supply 211 is a DC power supply(bias power supply) for applying a DC voltage to a bias electrode 212 and electrically connected to the electrode 212.

Electrophotographic photosensitive members are manufactured by using the deposited film forming apparatus as described below. First, the reactor 201 is evacuated by a vacuum pump (not shown) through the exhaust pipe 204 and the internal pressure of the reactor 201 is adjusted to $1\times10^{-7}$ Torr or less. Then the temperature of the substrate 205 is raised to and maintained at a specified degree by a heater 207. Starting material gases such as a silane gas as the starting material gas for amorphous silicon, a diborane gas as a doping gas and a helium gas as a diluted gas are introduced into the reactor 201 through gas guide means not shown. Simultaneously in parallel, a microwave of 2.45 GHz frequency is generated by the microwave power supply (not shown) and introduced into the reactor 201 through the waveguide 203 and the dielectric window 202. In addition, a DC voltage for the substrate 205 is applied to the bias electrode 212 from the DC power supply 211 which is electrically connected to the bias electrode 212' in the discharging space 206. Thus, in the discharging space 206 surrounded by the substrate 205, starting material gases are excited and dissociated and, while the substrate 205 is normally subjected to an ion impact from a field between the bias electrode 212 and the substrate 205, a deposited film is formed on the surface of the substrate 205. A rotary shaft 209 on which the substrate 205 is mounted is rotated by the motor 210 to rotate the substrate 205 around the center axis in the direction of generator of the substrate 205 whereby the deposited film is uniformly formed all over the substrate 205.

In the present invention, it is preferable to use water containing, particularly, a surface active agent in precleaning. Though any kind of quality of water before the surface active agent is dissolved in water is available for water cleaning, a semiconductor grade purified water, particularly a super LSI grade purified water is preferable. Specifically, for the present invention, the lower limit value of resistivity at the water temperature of 25° C. is 1MΩ.cm or more as a preferable value, 3MΩ.cm or more as a more preferable value, or 5MΩ.cm or more as a most suitable value, and the upper limit value of resistivity is 17MΩ.cm or less as a preferable value, 15MΩ.cm or less as a more preferable value, or 13MΩ.cm or less as a most suitable value from the viewpoint of costs and productivity, though any value up to a theoretical value (18.25MΩ.cm) is available. For the present invention, a quantity of fine grains of 0.2 Brp, or more in diameter per milliliter is 10000 pieces or less as a preferable value, 1000 pieces or less as a more preferable value and 100 pieces or less as a most suitable value. For the present invention, a total number of live microbes per milliliter is 100 units or less as a preferable value, 10 units or less as a more preferable value and one unit or less as a most suitable value. For the present invention, the organic substance amount (TOC) per liter is 10 mg or less as a preferable value, 1 mg or less as a more preferable value and 0.2 mg or less as a most suitable value.

As a method for obtaining water of the quality described above, an active charcoal method, a distillation method, an ion exchange method, a filter filtration method, a reverse osmosis method and an ultraviolet ray sterilization method are available. It is preferable to improve the water quality to the required level by combining a plurality of these methods.

If water temperature is excessively high, an oxidized film is formed on the substrate to cause exfoliation of the deposited film. If it is excessively low, the cleaning effect is low and the effect of the present invention cannot be attained. Therefore, for the present invention, an appropriate water temperature is 10° C. or more and 90° C. or less as a preferable value, from 20° C. to 75° C. as a more preferable value, and from 30° C. to 55° C. as a most suitable value.

The surface active agents available for the precleaning step according to the present invention include an anionic surface active agent, a cationic surface active agent, a nonionic surface active agent, an amphoteric surface active agent and a mixture of these surface active agents. Of the above, anionic surface active agents such as carboxylate, sulfonate, sulfate and phosphate or nonionic surface active agents such as fatty acid ester are particularly effective in the present invention. Phosphate, carbonate, silicate, borate or the like can be effectively used as a builder. Gluconate, EDTA, NTA, phosphate or the like can be effectively used as a chelating agent.

The use of ultrasonic waves in the present invention is effective for ensuring the effect of the present invention. An effective frequency of ultrasonic wave is 100 Hz or more and 10 MHz or less as a preferable value, 1 kHz or more and 5 MHz or less as a more preferable value and 10 kHz or more and 100 kHz or less as a most suitable value. An effective output of ultrasonic wave is 0.1 W/liter or more and 1 kW/liter or less as a preferable value and 1 W/liter or more and 100 W/liter or less as a more preferable value.

In the present invention, the quality of water to be used in the cleaning step with water in which carbon dioxide is dissolved is extremely important and is preferably a semiconductor grade purified water and a super LSI grade super purified water in the state before carbon dioxide is dissolved. Specifically, for the present invention, the lower limit value of resistivity at the water temperature of 25° C. is 1MΩ.cm or more as a preferable value, 3MΩ.cm or more as a more preferable value, or 5MΩ.cm or more as a most suitable value, and the upper limit value of resistivity is 17 MΩ.cm or less as a preferable value, 15MΩ.cm or less as a more perferable value, or 13MΩ.cm or less as a most suitable value from the viewpoint of costs and productivity, though any value up to a theoretical value (18.25MΩ.cm) is available. In the present invention, a quantity of fine grains of 0.2 μm or more in diameter per milliliter is 10000 pieces or less as a preferable value, 1000 pieces or less as a more preferable value and 100 pieces or less as a most suitable value. For the present invention, a total number of live microbes per milliliter is 100 units or less as a preferable value, 10 units or less as a more preferable value and one unit or less as a most suitable value. For the present invention, the organic substance amount (TOC) per liter is 10 mg or less as a preferable value, 1 mg or less as a more preferable value and 0.2 mg or less as a most suitable value.

As a method for obtaining water of the quality described above, an active charcoal method, a distillation method, an ion exchange method, a filter filtration method, a reverse osmosis method and an ultraviolet ray sterilization method are available. It is preferable to improve the water quality to the required level by combining a plurality of these methods.

Though any quantity up to the saturated solubility of carbon dioxide to be dissolved in water is available in the present invention, foams will be produced and will adhere to the surface of the substrate to result in spot stains thereon when the water temperature changes if the quantity of carbon dioxide is excessive. In addition, the pH value becomes small if the quantity of dissolved carbon dioxide is excessive, and therefore the substrate may be damaged. On the other hand, if the quantity of carbon dioxide is insufficient, the effect of the present invention cannot be attained.

The quantity of carbon dioxide to be dissolved should be optimized in accordance with the treatment conditions while taking the required quality for the substrate into account.

A preferable quantity of carbon dioxide to be dissolved according to the present invention is generally 60% or less of the saturated solubility and a more preferable quantity is 40% or less.

It is practically effective to control the quantity of carbon dioxide to be dissolved according to the present invention in terms of conductivity or pH value. The range of quantity of carbon dioxide to be dissolved in which the effect of the present invention is remarkable under the control in terms of the conductivity is preferably 2 μS/cm or more and 40 μS/cm or less, more preferably from 4 μS/cm to 35 μS/cm, most preferably from 6 μS/cm to 30 μS/cm, and under the control in terms of the pH value is preferably 3.8 or more and 6.0 or less and more preferably 4.0 or more and 5.0 or less. The conductivity is measured with a conductivity meter and a value converted at 25° C. according to temperature compensation is used.

If water temperature is excessively high, an oxidized film is formed on the substrate to cause exfoliation of the deposited film. If it is excessively low, the cleaning effect is low and the effect of the present invention cannot be attained. Therefore, for the present invention, an appropriate water temperature is 10° C. or more and 90° C. or less as a preferable value, from 20° C. to 75° C. as a more preferable value, and from 30° C. to 55° C. as a most suitable value.

A bubbling method and a method using a diaphragm are available for dissolving carbon dioxide in water. In the present invention, it is important to use water in which carbon dioxide is dissolved and, if carbonate such as sodium carbonate is used to obtain carbonate ion, the effect of the present invention is impaired by cation such as sodium ion.

A dipping method and a water spraying method are available for cleaning the substrate surface with water containing dissolved carbon dioxide thus obtained.

For cleaning the substrate by the dipping method, the substrate is basically immersed into a bath filled with water in which carbon dioxide has been dissolved. In this case, the present invention will be more effective by simultaneously applying ultrasonic waves, water stream and bubbling with introduction of air.

If the water pressure in the water spraying method is excessively low, the effect of the present invention will be small and, if it is excessively high, a pear skin pattern will appear on an image, particularly, a half-tone image of the electrophotographic photosensitive member obtained. In the present invention, therefore, an appropriate water pressure is preferably 2 kg . f/cm$^2$ or more and 300 kg . f/cm$^2$ or less, more preferably 10 kg . f/cm$^2$ or more and 200 kg . f/cm$^2$ or less, and most suitably from 20 kg . f/cm$^2$ to 150 kg . f/cm$^2$. However, the pressure unit "kg . f/cm$^2$" in the present invention means a gravity kilogram per centimeter square and 1kg . f/cm$^2$ is equivalent to 98066.5 Pa.

The water spraying method is such that high-pressurized water in a pump is sprayed from nozzles or water pumped up by a pump is mixed with high pressure air in front of the nozzles and sprayed by a pneumatic pressure.

An appropriate flow rate of water for each substrate is preferably from one liter/min. to 200 liters/min., more preferably from 2 liters/min. to 100 liters/min., most suitably from 5 liters/min. to 50 liters/min.

If water temperature is excessively high, an oxidized film is formed on the substrate to cause exfoliation of the deposited film and the effect of the present invention cannot be fully attained. It is difficult to make carbon dioxide stably dissolved in water. On the contrary, if water temperature is excessively low, the effect of the present invention cannot also be fully attained as 10 described above. In the present invention, therefore, an appropriate water temperature is preferably 5° C. or more and 90° C. or less, more preferably 10° C. or more and 55° C. or less, and most suitably 15° C. or more and 40° C. or less.

If the treating time in cleaning the substrate with water in which carbon dioxide has been dissolved is excessively long, an oxidized film is formed on the substrate and, if it is excessively short, the effect of the present invention will be insufficient. Therefore an appropriate treating time in water cleaning is preferably 10 seconds or more and 30 minutes or less, more preferably 20 seconds or more and 20 minutes or less and most suitably 30 seconds or more and 10 minutes or less.

In the present invention, it is important to carry out cutting of the substrate surface shortly before the deposited film is formed to remove the effect of the oxide film or the like on the substrate surface which has been formed upon formation of the deposited film.

If a time from cutting to cleaning with water containing dissolved carbon dioxide is excessively long, the oxide film is formed again on the substrate surface and, if it is excessively short, the steps will be unstable. Therefore an appropriate time is preferably 1 minute or more and 16 hours or less, more preferably 2 minutes or more and 8 hours or less and most suitably 3 minutes or more and 4 hours or less.

If a time from cleaning treatment with water containing dissolved carbon dioxide to feeding into the deposited film forming apparatus is excessively long, the effect of the present invention will be small and, if it is excessively short, the steps will be unstable. Therefore, in the present invention, an appropriate time is preferably 1 minute or more and 8 hours or less, more preferably 2 minutes or more and 4 hours or less, and most suitably 3 minutes or more and 2 hours or less.

Any of hot air drying, vacuum drying, hot water drying and the like is effective as a drying step in the present invention. Drying with hot water in which carbon dioxide is dissolved is particularly preferable to raise the effect of the present invention.

In the present invention, the quality of water to be used in the hot water drying step with water in which carbon dioxide is dissolved is extremely important and is preferably a semiconductor grade purified water and a super LSI grade super purified water in the state before carbon dioxide is dissolved. Specifically, for the present invention, the lower limit value of resistivity at the water temperature of 25° C. is 1MΩ.cm or more as a preferable value, 3MΩ.cm or more as a more preferable value, or 5MΩ.cm or more as a most suitable value, and the upper limit value of resistivity is 17MΩ.cm or less as a preferable value, 15MΩ.cm or less as a more preferable value, or 13MΩ.cm or less as a most suitable value from the viewpoint of costs and productivity, though any value up to a theoretical value (18.25MΩ.cm) is available. In the present invention, a quantity of fine grains of 0.2 μm or more in diameter per milliliter is 10000 pieces or less as a preferable value, 1000 pieces or less as a more preferable value and 100 pieces or less as a most suitable value. For the present invention, a total number of live microbes per milliliter is 100 units or less as a preferable value, 10 units or less as a more preferable value and one unit or less as a most suitable value. For the present invention, the total organic carbon (TOC) per liter is 10 mg or less as a preferable value, 1 mg or less as a more preferable value and 0.2 mg or less as a most suitable value.

As a method for obtaining water of the quality described above, an active charcoal method, a distillation method, an ion exchange method, a filter filtration method, a reverse osmosis method and an ultraviolet ray sterilization method are available. It is preferable to improve the water quality to the required level by combining a plurality of these methods.

Though any quantity up to the saturated solubility of carbon dioxide to be dissolved in water is available in the present invention, foams will be produced and will adhere to the surface of the substrate to result in spot stains thereon when the water temperature changes if the quantity of carbon dioxide is excessive. In addition, the pH value becomes small if the quantity of dissolved carbon dioxide is excessive, and therefore the substrate may be damaged. On the other hand, if the quantity of carbon dioxide is insufficient, the effect of ensuring to obtain the uniform substrate surface cannot be improved.

The quantity of carbon dioxide to be dissolved should be optimized in accordance with the treatment conditions while taking the required quality for the substrate into account.

A preferable quantity of carbon dioxide to be dissolved according to the present invention is generally 60% or less of the saturated solubility and a more preferable quantity is 40% or less.

It is practically effective to control the quantity of carbon dioxide to be dissolved according to the present invention in terms of conductivity or pH value. The range of quantity of carbon dioxide to be dissolved in which the effect of the present invention is remarkable under the control in terms of the conductivity is preferably 2 μS/cm or more and 40 μS/cm or less and more preferably 4 μS/cm or more, 35 μS/cm or less, most preferably from 6 μS/cm to 30 μS/cm, and under the control in terms of the pH value is preferably 3.8 or more and 6.0 or less and more preferably 4.0 or more and 5.0 or less. The conductivity is measured with a conductivity meter and a value converted at 25° C. according to temperature compensation is used.

A bubbling method and a method using a diaphragm are available for dissolving carbon dioxide in water as described above. In the present invention, it is important to use water in which carbon dioxide is dissolved and, if carbonate such as sodium carbonate is used to obtain carbonate ion, the effect of the present invention is impaired by cation such as sodium ion.

If water temperature is excessively high, an oxidized film is formed on the substrate to cause exfoliation of the deposited film. If it is excessively low, drying is insufficient and the effect of the present invention cannot be attained. Therefore, in the present invention, an appropriate water temperature is 30° C. or more and 90° C. or less as a preferable value, from 35° C. to 80° C. as a more preferable value, and from 40° C. to 70° C. as a most suitable value.

In the present invention, any kind of material is available for the substrate as far as it uses aluminum as the base and the effect of the present invention is particularly remarkable if the material containing silicon atoms is used. In the present invention, an appropriate content of silicon atoms is preferably 1 weight ppm or more and 1 weight % or less and more preferably 10 weight ppm or more and 0.1 weight % or less.

In the present invention, it is effective to contain magnesium to improve workability of the substrate. An appropriate content of magnesium is preferably 0.1 weight % or more and 10 weight % or less and more preferably 0.2 weight % or more and 5 weight % or less.

In addition, in the present invention, it is effective to contain such substances as H, Li, Na, K, Be, Ca, Ti, Cr, Mn, Fe, Co, Ni, Cu, Ag, Zn, Cd, Hg, B, Ca, In, C, Si, Ge, Sn, N, P, As, O, S, Se, F, Cl, Br, and I in aluminum.

In the present invention, the substrate can be formed in any shape and particularly a cylindrical form is best suited to the present invention. Though the size of the substrate is not limited, it is preferable for practical use to be from 20 mm to 500 mm in diameter and from 10 mm to 1000 mm in length.

As a photosensitive member for use in the present invention, an amorphous silicon photosensitive member, a selenium photosensitive member, a cadmium sulfide member, an organic material photosensitive member or the like is available. The effect of the present invention is particularly remarkable with a non-monocrystalline photosensitive member containing silicon such as amorphous silicon-based photosensitive members which have at least one material to be selected from amorphous silicon, amorphous germanium silicon, amorphous germanium and amorphous silicon carbide.

For non-monocrystalline photosensitive members containing silicon, starting gases such as silane ($SiH_4$), disilane ($Si_2H_6$), silicon tetra fluoride ($SiF_4$) and disilicon hexafluoride ($Si_2F_6$) or a mixture of these gases are available as the starting gas to be used in formation of the deposited film.

Hydrogen ($H_2$), argon (Ar) and helium (He) are available as a diluted gas.

As a characteristic improving gas for changing a band gap width of the deposited film is available a gas containing nitrogen atoms such as nitrogen ($N_2$) and ammonia ($NH_3$), a gas containing oxygen atoms such as oxygen ($O_2$), nitrogen monoxide (NO), nitrogen dioxide ($NO_2$), nitric oxide ($N_2O$), carbon monoxide (CO) and carbon dioxide ($CO_2$), hydrocarbon such as methane ($CH_4$), ethane ($C_2H_6$), ethylene ($C_2H_4$), acetylene ($C_2H_2$) and propane ($C_3H_8$), fluorides such as germanium tetrafluoride ($GeF_4$) and nitrogen fluoride ($NF_3$) or a mixture of these gases.

In the present invention, a similar effect is obtained by simultaneously introducing dopant gases such as diborane ($B_2H_6$), boron fluoride ($BF_3$) and phosphine ($PH_3$) for the purpose of doping.

In the case of the electrophotographic photosensitive member according to the present invention, though the total film thickness of the deposited film (functional film) on the substrate can be as required, particularly satisfactory images can be obtained on the electrophotographic photosensitive member when the total film thickness is preferably 5 μm or more and 100 μm less, more preferably 10 μm more and 70 μm less and most suitably 15 μm or more and 50 μm or less.

Though the effect of the present invention is recognized even if the pressure of the discharging space while the deposited film is being formed is applied to any area, particularly satisfactory results of discharging stability and uniformity of the deposited film can be obtained in high repeatability when an appropriate pressure is preferably 0.5 m Torr or more and 100 m Tort or less and more preferably 1 m Torr or more and 50 m Torr or less in the case that the ultrasonic wave band is used.

In the present invention, the range of the temperature of the substrate in formation of the deposited film can be, for example, 100° C. or more and 500° C. or less and a remarkable effect of the present invention can be recognized when the temperature of the substrate is preferably 150° C. or more and 450° C. or less, more preferably 200° C. or more and 400° C. or less, and most suitably 250° C. or more and 350° C. or less.

In the present invention, substrate heating means can be a heat generating member of vacuum specification, specifically,an electric resistance heat generating member such as a wound heater as a sheathed heater, a plate type heater and ceramics heater, a radiation lamp heat generating member such as a halogen lamp and infrared ray lamp, a heat generating member based on heat exchanging means using liquid and gas as a thermal medium. Metals such as stainless steel, nickel, aluminum and copper, ceramics and heat-resistant polymer resin can be used as a material for the surface of heating means. Alternatively, another method can be used for which a container exclusively for heating is provided in addition to the reactor and the substrate is transported under vacuum in the reactor after heating. The present invention allows to use the above means independently or in combination.

In the present invention, the energy for generating the plasma to be used to form the functional film is available in any term of DC, RF or microwave. Particularly, when the microwave is used as the energy for generating the plasma, abnormal growth due to a surface defect of the substrate remarkably occurs, the microwave is absorbed by water absorbed and a change of the interface becomes more remarkable and therefore the effect of the present invention will also be more remarkable.

Though, if the microwave is used to generate the plasma in the present invention, the microwave power can be as large as required to cause discharging, an appropriate microwave power to execute the present invention is preferably 100 W or more and 10 kW or less, and more preferably 500 W or more and 4 kW or less.

In the present invention, it is effective to apply a voltage (bias voltage) to the discharging space during formation of the deposited film and it is preferable that a field is applied in a direction where the cation collides at least with the substrate. If the voltage to be applied is not biased, the effect of the present invention may be substantially reduced and therefore it is desired for a higher effect of the present invention to apply a bias voltage a DC component voltage of which is preferably 1 V or more and 500 V or less and more preferably 5 V or more and 100 V or less while the deposited film is being formed.

In the present invention, such materials alumina ($Al_2O_3$), aluminum nitride (AlN), boron nitride (BN), silicon nitride (SiN), silicon carbonate (SiC), silicon oxide ($SiO_2$), beryllium oxide (BeO), Teflon, and polystyrene with less loss of microwave energy are generally used as a material for the dielectric window for introducing the microwave into the reactor.

In a deposited film forming method for a configuration in which the discharging space is surrounded by a plurality of substrates, a preferable clearance between substrates is 1 mm or more and 50 mm or less. Though the number of substrates can be as many as required as far as the discharging space can be formed, an appropriate number of substrates is preferably 3 or more and more preferably 4 or more.

The present invention is applicable to any method for manufacturing electrophotographic photosensitive members and, particularly, provides a larger effect when forming the deposited film by an arrangement wherein the substrates are provided to surround the discharging space and the microwave is introduced through the waveguide from at least one-end side of the substrates.

Figure 4:
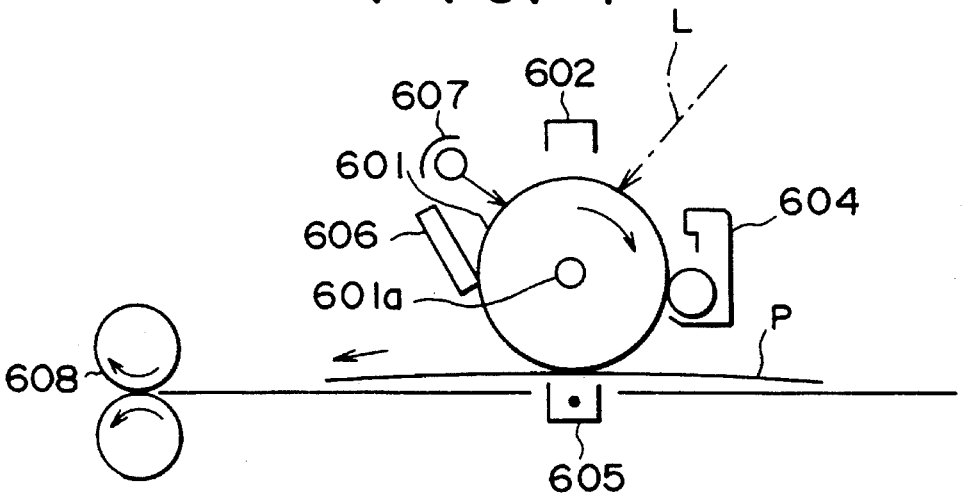
FIG. 4 is a schematic configuration of a general transfer type eletrophotographic apparatus.

FIG. 4 shows an example of a schematic configuration of a general transfer type electrophotographic apparatus using an electrophotographic photosensitive member manufactured by the method of the present invention.

In FIG. 4, numerals 601 denote an electrophotographic photosensitive member as an image carrier, which is driven to rotate around a shaft 601*a* as the center at a specified peripheral speed in an arrow direction. In the process of rotation, this electrophotographic photosensitive member is subjected to a uniform charge of a specified positive or negative potential at its peripheral surface by charging means 602 and to a light figure exposure L (slit exposure, laser beam scanning exposure or the like) by image exposing means, not shown, of an exposure section. Thus a static latent image corresponding to an exposed image is formed in sequence on the periphery of the photosensitive member.

This static latent image is toner-developed by developing means 604 and a toner-developed image is transferred in sequence by transfer means on a surface of transfer material P from an unwinding part, not shown, synchronized with rotation of the photosensitive member 601 between the photosensitive member 601.

The transfer material P onto which the image has been transferred is separated from the surface of the photosensitive member and introduced into image fixing means 608 whereby the image on the transfer material P is fixed and printed as a copy out of the apparatus.

The surface of the photosensitive member 601 after the image has been transferred thereto is cleaned by cleaning means 606 to remove the remaining toner and further treated to remove static charge by preexposure means 607, then repeatedly used for image formation.

A corona charging apparatus is widely used as uniform charging means 602 for the photosensitive member 601. The corona charging apparatus is widely used in the transfer apparatus 605. Of the above-described components such as the photosensitive member, developing means and cleaning means, a plurality of components can be integrally assembled as the electrophotographic unit and this unit can be remountably arranged on the body of the apparatus. In this case, the arrangement of the unit can include charging means and/or developing means.

If the electrophotographic apparatus is used as a copier or a printer, the light figure exposure L can be a light reflected from or passing through the original script or can be obtained from scanning of a laser beam according to a signal which is obtained by signalizing the reading from the original script, driving of the LED array or driving of the liquid crystal shutter array.

Figure 5:
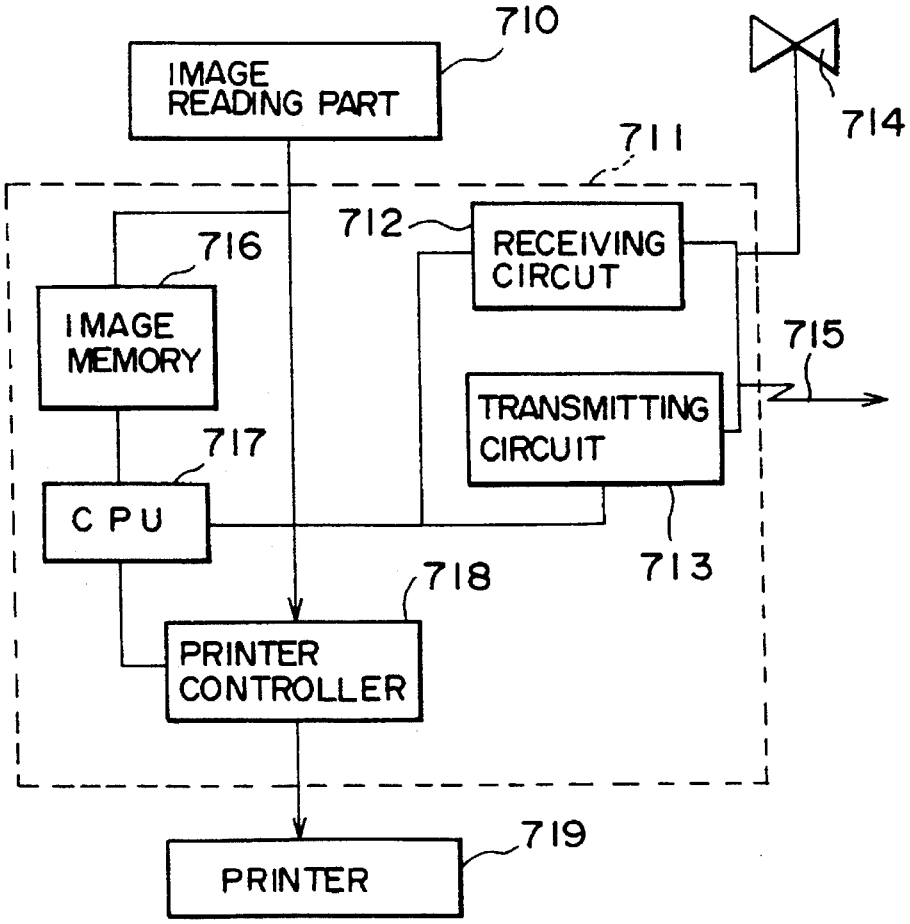
FIG. 5 is a block diagram of a facsimile apparatus used as the electrophotographic apparatus shown in FIG. 4 as a printer.

If the electrophotographic apparatus is used as a printer of a facsimile apparatus, the light figure exposure L is the exposure for printing received data. FIG. 5 shows an example in this case as a block diagram.

A controller 711 controls an image reader 710 and a printer 719. The controller 711 as a show is controlled by a CPU 717. Data read from the image reader 710 is transmitted to the partner station through a transmission circuit 713. Data received from the partner station is transmitted to the printer 719 through the receiving circuit 712. Specified image data is stored in an image memory 716. A printer controller 718 controls the printer 719. 714 is a telephone.

When the image information received from a line 715 (from a remote terminal connected through a line) is decoded by a CPU 717, after having been demodulated in a receiving circuit 712, and stored in sequence in an image memory 716, the image of the corresponding page is stored. The CPU 717 reads out the image information as much as one page from the memory 716 and transmits out the image information of one page decoded to a printer controller 718. The printer controller 718 controls the printer so that the printer stores the image information of one page when the printer controller 718 receives the image information of one page from the CPU 717.

The CPU 717 receives the image information of the next page while recording is carried out by the printer 719.

As described above, the image is received and recorded.

The electrophotographic photosensitive members manufactured by the method according to the present invention not only can be used in the electrophotographic copier but also can be widely used in the field of electrophotographic applications including laser beam printers, CRT printers, LED printers, liquid crystal printers and laser plate makers.

Though the effects of the present invention are specifically described referring to the experimental examples, the present invention is not limited to the above.

EXPERIMENT 1

Correlation of the quantity of carbon dioxide to be dissolved in water to occurrence of image defects was checked by varying the quantity of carbon dioxide. The surface of a cylindrical substrate made of aluminum with the content of silicon atoms of 100 ppm and the diameter of 108 mm, length of 358 mm and thickness of 5 mm was cut in the same procedure as an example of the procedure of the above described manufacturing method of electrophotographic photosensitive members according to the present invention.

Fifteen minutes later from completion of the cutting process, cleaning with a detergent (non-ionic surface active agent) and that with water in which carbon dioxide is dissolved were carried out by the surface treatment apparatus shown in FIG. 2 according to the conditions shown in Table 1. In this case, water with carbon dioxide dissolved is given a conductivity of 1 μS/cm to 50 μS/cm by dissolving carbon dioxide in purified water having the resistivity of 10MΩ. cm.

Figure 2:
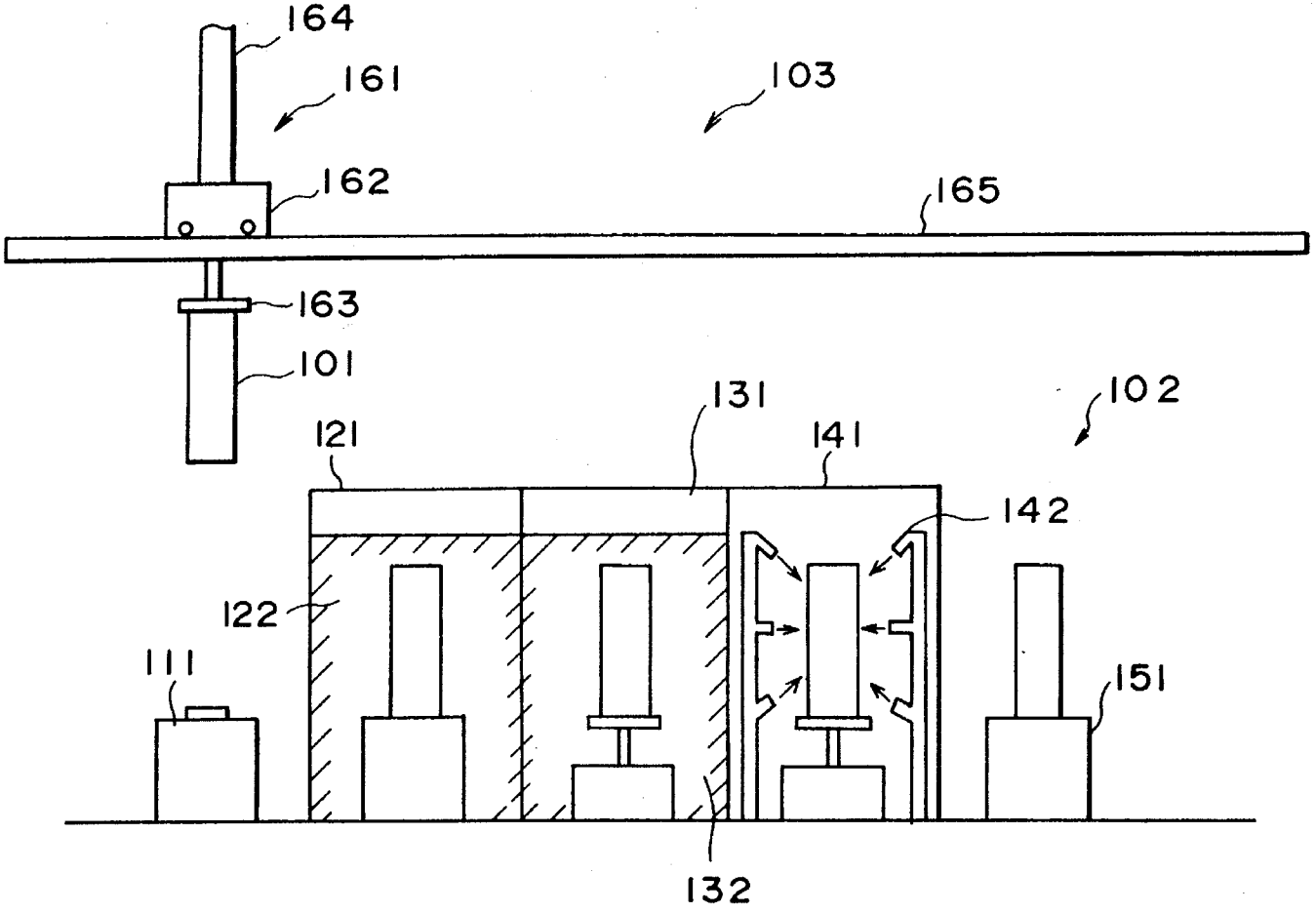
FIG. 2 is a schematic vertical sectional view of a substrate pretreatment apparatus to be used to execute a method for making electrophotographic photosensitive members according to the present invention.
Figure 6:
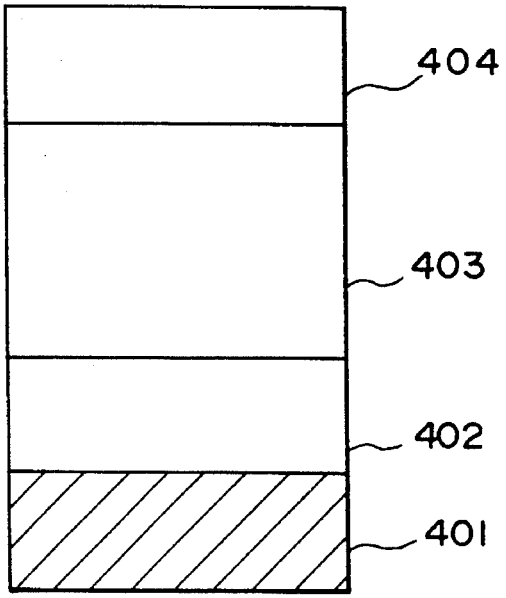
FIGS. 6 and 7 are respectively a schematic sectional view showing an example of layer structure of an electrophotographic photosensitive member.

Thereafter, using the deposited film forming apparatus shown in FIGS. 3A and 3B, an amorphous silicon deposited film was formed on the substrate under the conditions as shown in FIG. 2, then blocking type electrophotographic photosensitive members with the layer structure as shown in FIG. 6 were thus produced. In FIG. 6, reference numerals 401, 402, 403 and 404 denote an aluminum substrate, a charge injection blocking layer, a photoconductive layer and a surface layer, respectively.

Electrophotographic characteristics of electrophotographic photosensitive members thus produced were evaluated as described below. The electrophotographic photosensitive members produced were each set in the Canon copier NP7550 which had been modified in advance so that the processing speed could be varied as required in the range of 200 to 800 mm/sec for experiments, corona charging was conducted by applying a voltage of 6 to 7 kV to the charger, an image was produced on a transfer paper by an ordinary copying process and the image quality was evaluated in the following procedure. Evaluation was made on each ten electrophotographic photosensitive members thus produced under the same production conditions and the results of evaluation are shown in Table 3.

Evaluation of Image Defects (Faulty Image)

An image sample on which the number of image defects is largest was selected for evaluation from image samples obtained by individually copying full-surface halftone originals and character originals each set on the original aligning glass plate at different processing speeds. The image samples were evaluated by observing the copied surfaces of image samples with a magnifier and checking the condition of white spots in the same area.

AA: Satisfactory

A: Partly including small white spots

B: Though small white spots are observed on the whole surface, there is no problem in identification of characters.

C: Characters may be partly illegible because of a number of white spots.

Evaluation of black spots

An image was outputted so that an average density of a reproduced image obtained from a full-surface halftone original set on the original aligning glass plate at different processing speeds may be 0.4±0.1. An image sample on which black spots are most remarkable was selected from the image samples thus obtained and evaluated. The sample image was evaluated by observing it at a distance 40 cm away from the eyes of the observer and checking as to whether or not black spots could be observed.

AA: No black spots are observed on all copies.

A: A small n,lmber of black spots are observed on some copies. However, black spots are slight to be free from any problem.

B: Black spots are observed on all copies. However, black spots are slight and do not impede actual use.

C: Large black spots are observed on all copies in some cases.

Evaluation of electrophotographic characteristics

A surface potential of a photosensitive member which is obtained at a developing position when the same charging voltage is applied at a normal processing speed is evaluated as a charging ability from a relative value. However, the charging ability of the electrophotographic photosensitive member obtained in the comparative experiment 1 is defined as 100%.

Evaluation of environmental properties

A: Substances concerned with destruction of the ozone layer of the earth are not used in the pretreatment process.

B: Substances concerned with destruction of the ozone layer of the earth are used in the pretreatment process.

Comparative Experiment 1

An aluminum substrate containing silicon atoms of 100 ppm was cut in the same procedure as in the experiment 1.

Figure 8:
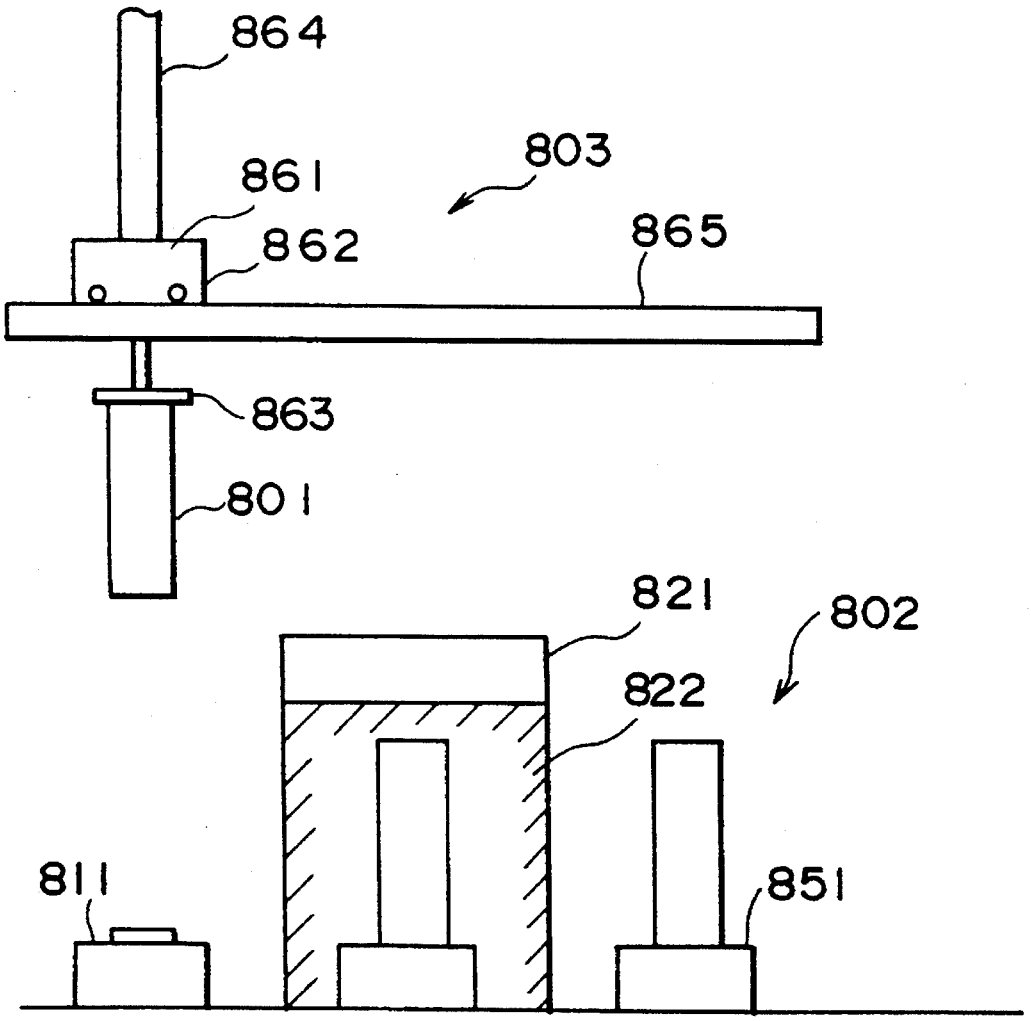
FIGS. 8 and 9 are respectively a schematic vertical sectional view of a cleaning apparatus for cleaning the substrate as pretreatment.

The surface of the substrate on which cutting had been completed was treated under the conditions as shown in Table 4 by the substrate cleaning apparatus shown in FIG. 8. The substrate cleaning apparatus shown in FIG. 8 comprises a treatment bath 802 and a substrate transport mechanism 803. The treatment bath 802 comprises a substrate feed stand 811, a substrate cleaning bath 821 and a substrate carry-out stand 851. The substrate cleaning bath 821 is provided with a thermostat (not shown) for maintaining liquid temperature at a fixed level. The substrate transport mechanism 803 comprises transport rail 865 and a transport arm 861, which comprises a moving mechanism 862 which moves on the rail 865, a catching mechanism 863 for holding the substrate 801 and an air cylinder 864 for vertically moving the catching mechanism 863. After cutting, the substrate 801 set on the substrate feed stand 811 is transported to the substrate cleaning bath 821 by the substrate transport mechanism 803. The substrate 801 is cleaned with trichloroethane (trade name: ETHANA VG manufactured by Asahi Chemical Industry Co., Ltd.) 822 in the substrate cleaning bath 821 to remove cutting oil and chip remaining on the substrate.

After cleaning, the substrate 801 is transported to the substrate carry-out stand 851 by the substrate transport mechanism 803.

Further thereafter, an amorphous silicon deposited film was formed on the substrate under the conditions shown in Table 2 by the deposit film forming apparatus shown in FIGS. 3A and 3B and a blocking type electrophotographic photosensitive member with a layer structure shown in FIG. 4 was produced.

The results of evaluation of the electrophotographic photosensitive member thus produced in the same manner as in the experiment 1 are shown as the comparative experiment 1 in Table 3.

Comparative Experiment 2

Fifteen minutes after the aluminum substrate containing silicon atoms of 100 ppm as in the experiment 1 had been cut in a similar procedure, the substrate was cleaned with a detergent (non-ionic surface active agent) and with pure water under the conditions shown in Table 5. The surface treatment apparatus shown in FIG. 2 was used and pure water in which carbon dioxide was not dissolved was introduced into the cleaning bath 131.

Further thereafter, an amorphous silicon deposited film was formed on the substrate under the conditions shown in Table 2 by the deposit film forming apparatus shown in FIGS. 3A and 3B and a blocking type electrophotographic photosensitive member with a layer structure shown in FIG. 6 was produced.

The results of evaluation of the electrophotographic photosensitive member thus produced in the same manner as in the experiment 1 are shown as the comparative experiment 2 in Table 3.

As clearly known from Table 3, the electrophotographic photosensitive member produced by the manufacturing method for electrophotographic photosensitive members according to the present invention provided extremely satisfactory results as to image defects in the range of conductivity from 2 μS/cm to 40 μS/cm of aqueous solution in which carbon dioxide had been dissolved.

Experiment 2

Fifteen minutes later from completion of cutting of an aluminum substrate in which the content of silicon atoms was varied in the same procedure as the experiment 1, the substrate was cleaned with water in which carbon dioxide had been dissolved under the conditions shown in Table 6 by using the substrate surface cleaning apparatus shown in FIG. 2. In this case, water used is such that its conductivity was adjusted to 20 BS/cm and the pH value was adjusted to approximately 4.2 by dissolving carbon dioxide in pure water with resistivity of 10MΩ. cm.

Further thereafter, an amorphous silicon deposited film was formed on the substrate under the conditions shown in Table 2 by the deposit film forming apparatus shown in FIGS. 3A and 3B and a blocking type electrophotographic photosensitive member with a layer structure shown in FIG. 6 was produced.

The results of evaluation of the electrophotographic photosensitive member thus produced in the same manner as in the experiment 1 are shown as the experiment 2 in Table 7. As clearly known from Table 7, the electrophotographic photosensitive member produced by the manufacturing method for electrophotographic photosensitive members according to the present invention provided extremely satisfactory results as to image defects in the range of the content of silicon atoms from 1 ppm to 1 weight in aluminum of the substrate.

Experiment 3

The surface of the substrate was pretreated under the conditions shown in Table 6 by using the substrate surface treatment apparatus shown in FIG. 2, 15 minutes later from completion of cutting in the same procedure as in the experiment 1.

Further thereafter, an amorphous silicon deposited film 10 was formed on the substrate under the conditions shown in Table 2 by the deposit film forming apparatus shown in FIGS. 3A and 3B and a blocking type electrophotographic photosensitive member with a layer structure shown in FIG. 6 was produced.

In this experiment, the electrophotographic photosensitive member was produced by changing the quality (resistivity) of pure water to be used in the cleaning process with water in which carbon dioxide had been dissolved. The electrophotographic photosensitive member thus produced was set on a modified machine of Canon NP7550 copier and similarly evaluated in the same procedure as in the experiment 1. Each ten electrophotographic photosensitive members produced under the same production conditions were evaluated and the results of evaluation obtained are shown in Table 8.

Those electrophotographic photosensitive members produced in the comparative experiments 1 and 2 were similarly evaluated and the results of evaluation obtained are shown in Table 8. In the table, costs were evaluated according to the following criteria.

Evaluation of costs

Costs for obtaining a required quantity of a required cleaning liquid:

AA: Available at extremely low costs

A: Available at low costs

B: Relatively expensive

C: Expensive

As known from Table 8, an extremely satisfactory result with respect to the image characteristics was obtained from the electrophotographic photosensitive members produced by the manufacturing method for electrophotographic photosensitive members according to the present invention when the resistivity of pure water to be used in the cleaning process with water in which carbon dioxide has been dissolved is 1MΩ. cm or more before carbon dioxide is dissolved.

The configuration of the present invention was determined in accordance with the results of the experiments described above. The following further specifically describes the configuration, referring to the examples and comparative examples of the present invention.

Example 1

The surface of a cylindrical substrate made of aluminum with the content of silicon atoms of 100 ppm and the diameter of 108 mm, length of 358 mm and thickness of 5 mm was cut in the same procedure as an example of the procedure of the above described manufacturing method of electrophotographic photosensitive members according to the present invention. 15 minutes later from completion of cutting, the surface of the substrate was treated under the conditions shown in Table 9 by the substrate surface treatment apparatus shown in FIG. 1. In this case, the detergent used is a mixture of the non-ionic surface active agent and the anionic surface active agent.

Further thereafter, an amorphous silicon deposited film was formed on the substrate under the conditions shown in Table 2 by the deposit film forming apparatus shown in FIGS. 3A and 3B and a blocking type electrophotographic photosensitive member with a layer structure shown in FIG. 6 was produced.

Evaluation of the electrophotographic characteristics of the electrophotographic photosensitive members thus produced was conducted as described below. Each ten photosensitive members produced under the same film forming conditions were evaluated. After visual observation and evaluation of the appearance of the electrophotographic photosensitive member thus produced to check exfoliation of the film, the electrophotographic photosensitive member was set on a reproducing apparatus modified for the experiments from Canon copier NP7550, an image was reproduced on a transfer paper by a usual reproducing process and the image characteristics were evaluated. In this case, however, corona charging was conducted by applying a 6 kV voltage to the charger. The results of these evaluations are shown as "Present Invention" in Table 10.

Evaluation of image defects (faulty image)

Image defects were evaluated in the same procedure as in the experiment 1 according to the evaluation criteria.

Evaluation of black spots

Black spots were evaluated in the same procedure as in the experiment 1 according to the evaluation criteria.

Evaluation of electrophotographic characteristics

Electrophotographic characteristics were evaluated in the same procedure as in the experiment 1 according to the evaluation criteria.

Evaluation of environmental properties

Environmental properties were evaluated in the same procedure as in the experiment 1 according to the evaluation criteria.

Evaluation of uneven image

An A3-size section paper was set on the original aligning glass plate of the copier and ten sheets of copies with different densities were outputted by changing the exposure dose to the original so that those images in the range from the extent that the lines of graphs can be barely observed to the extent that white background fogging begins may be obtained, and ten sheets of copies were outputted.

These images were observed at a distance 40 cm away from the eyes of the observer to check a difference in the density and the evaluation was conducted according to the following criteria.

AA: An uneven image is not observed on any copy.

A: There are copies on which an uneven image is observed and copies on which no uneven image is observed. However, unevenness is slight and there is no problem.

B: An uneven image is observed on all copies. However, unevenness is slight on a sheet of copy and does not impede practical use.

C: A remarkable large uneven image is observed on all copies in some cases.

Evaluation of white-background fogging

Image samples obtained when an ordinary which contains characters over the white background is set on the original aligning glass plate and copied were observed and white background fogging was evaluated.

AA: Satisfactory

A: Partial white-background fogging is observed.

B: Though fogging is observed all over the original, identification of characters is not impeded.

C: In some cases, characters are partly illegible due to fogging.

Comparative Example 1

After a substrate similar to the aluminum substrate of Example 1 having no silicon atoms has been cut in the same procedure, the surface of the substrate was cleaned under the conditions shown Table 4 by using the substrate cleaning apparatus shown in FIG. 8 according to the conventional method.

Further thereafter, an amorphous silicon deposited film was formed on the substrate under the conditions shown in Table 11 by using the deposit film forming apparatus shown in FIG. 1 and a blocking type electrophotographic photosensitive member with a layer structure shown in FIG. 6 was produced as in Example 1.

Evaluation of the electrophotographic characteristics of the electrophotographic photosensitive members thus produced was conducted as described in Example 1 and the results are shown as "Comparative Example 1" in Table 10.

Comparative Example 2

Figure 9:
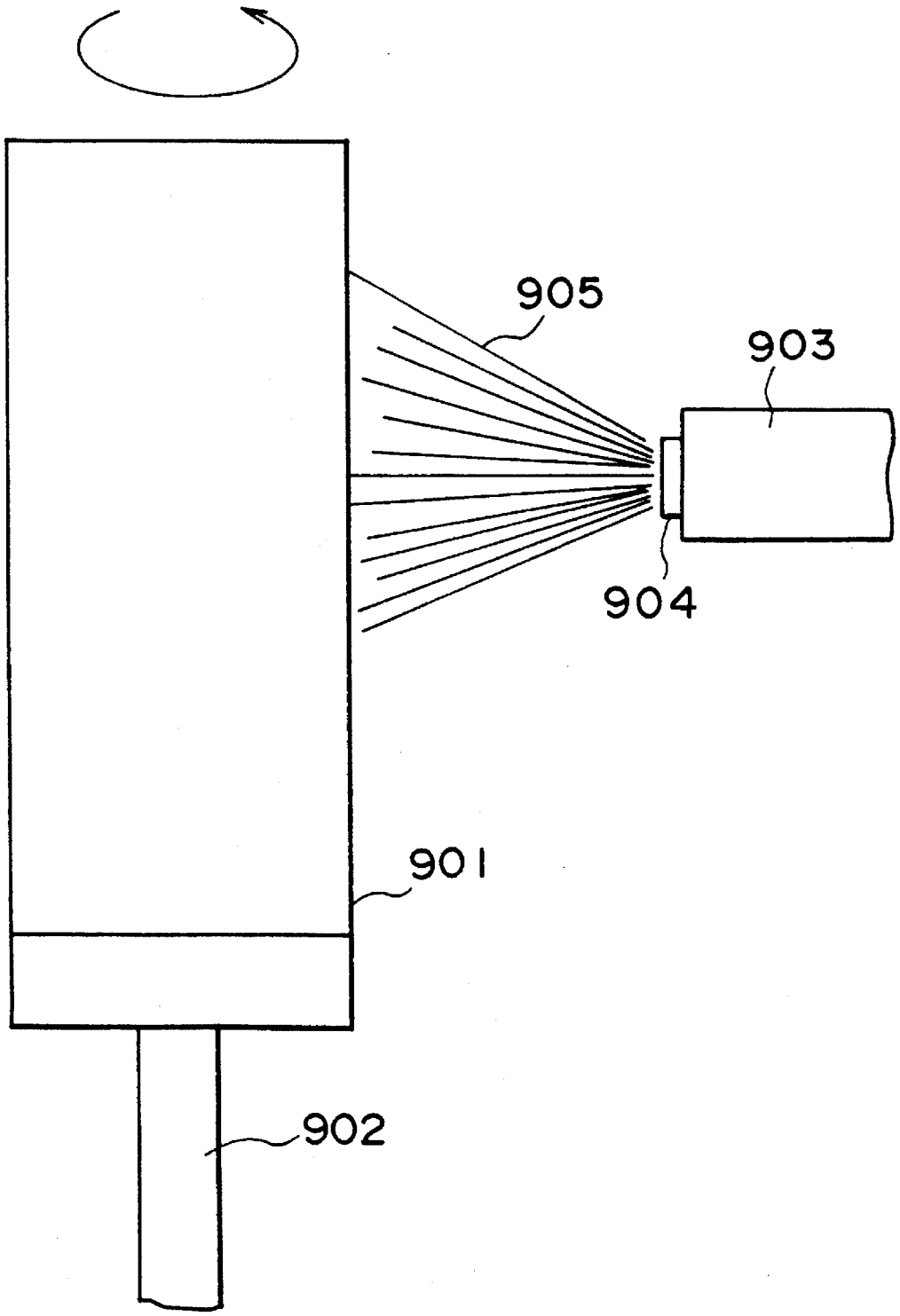

After an aluminum substrate which does not contain silicon atoms had been cut in a similar procedure to the Example 1, the substrate surface was cleaned by using the water cleaning apparatus for cleaning the substrate surface shown in FIG. 9. The substrate cleaning apparatus shown in FIG. 9 comprises a rotary shaft 902 for fixing and rotating the substrate 901, a sprayer 903 for spraying the cleaning liquid to the substrate and the nozzle 904.

In this comparative example, this cleaning apparatus was used to clean the substrate surface under the conditions shown in Table 12.

Further thereafter, an amorphous silicon deposited film was formed on the substrate under the conditions shown in Table 11 by using the deposit film forming apparatus shown in FIG. 1 and a blocking type electrophotographic photosensitive member with a layer structure shown in FIG. 6 was produced as in the Example 1.

Evaluation of the electrophotographic characteristics of the electrophotographic photosensitive members thus produced was conducted as described in the Example 1 and the results are shown as "Comparative Example 2" in Table 10.

Extremely satisfactory results were obtained with respect to all items as shown in the table from the electrophotographic photosensitive members produced by the manufacturing method for electrophotographic photosensitive members according to the present invention as compared with the electrophotographic photosensitive members obtained in the comparative examples.

Example 2

The layer structure of the electrophotographic photosensitive member was changed to be different from that of the Example 1 and the electrophotographicphotosensitive member was produced by the manufacturing method for electrophotographic photosensitive members according to the present invention. 15 minutes later from completion of cutting the substrate in a similar procedure to the Example 1, the substrate surface was treated under the conditions shown in Table 9 by using the substrate surface treatment apparatus shown in FIG. 2.

Figure 7:
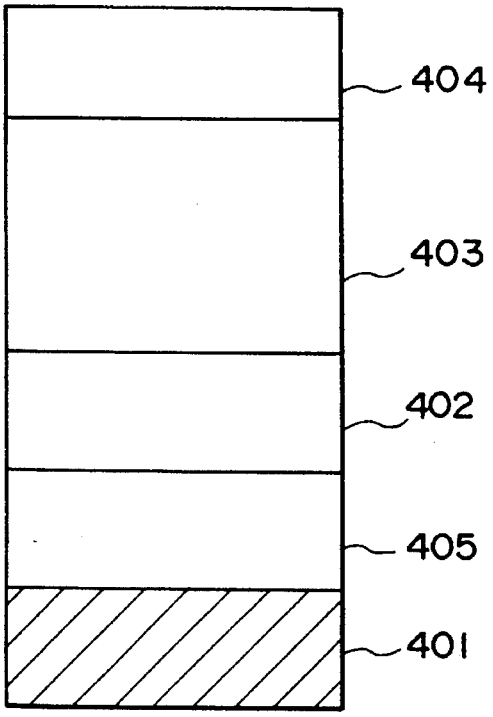

Further thereafter, an amorphous silicon deposited film was formed on the substrate under the conditions shown in Table 13 by using the deposit film forming apparatus shown in FIGS. 3A and 3B and a blocking type electrophotographic photosensitive member with a layer structure shown in FIG. 7 was produced as in the Example 1.

In FIG. 7, 401 is an aluminum substrate, 405 is an infrared ray absorbing layer, 402 is a charge injection blocking layer, 403 is a photoconductive layer and 404 is a surface layer.

The electrophotographic photosensitive member thus obtained was evaluated in a similar procedure to the Example 1. Consequently, also in this Example, an extremely satisfactory result was obtained with respect to all items from the electrophotographic photosensitive member produced by the manufacturing method for electrophotographic photosensitive members according to the present invention as in the Example 1.

Example 3

Fifteen minutes later from completion of cutting the substrate in a similar procedure to the Example 1, the substrate surface was treated under the conditions shown in Table 9 by using the substrate surface treatment apparatus shown in FIG. 2.

Further thereafter, an amorphous silicon deposited film was formed on the substrate under the conditions shown in Table 11 by using the deposit film forming apparatus shown in FIG. 1 and a blocking type electrophotographic photosensitive member with a layer structure shown in FIG. 6 was produced.

The electrophotographic photosensitive member thus obtained was evaluated in a similar procedure to the Example 1. Consequently, also in this Example, an extremely satisfactory result was obtained with respect to all items from the electrophotographic photosensitive member produced by the manufacturing method for electrophotographic photosensitive members according to the present invention as in the Example 1.

Example 4

The surface of a cylindrical of 108 mm in diameter, 358 mm in length and 5 mm in thickness made of aluminum containing silicon atoms of 300 ppm and simultaneously magnesium atoms of 2 weight % was cut in a similar procedure to the above-described manufacturing method for electrophotographic photosensitive members according to the present invention. Then, 15 minutes later from completion of the cutting process, pretreatment of the substrate surface was carried out under the conditions shown in Table 14 by the substrate surface cleaning apparatus shown in FIG. 2. In this Example, a non-ionic surface active agent was used as the detergent to be used for the precleaning process.

Further thereafter, an amorphous silicon deposited film was formed on the substrate under the conditions shown in Table 2 by using the deposit film forming apparatus shown in FIGS. 3A and 3B and a blocking type electrophotographic photosensitive member with a layer structure shown in FIG. 6 was produced as in the embodiment 1.

The electrophotographic photosensitive member thus obtained was evaluated in a similar procedure to the Example 1. Consequently, also in this Example, an extremely satisfactory result was obtained with respect to all items from the electrophotographic photosensitive member produced by the manufacturing method for electrophotographic photosensitive members according to the present invention as in the Example 1.

As effects of magnesium contained, the cutting workability was improved and the failure rate in cutting was reduced to ½.

Example 5

Fifteen minutes later from completion of cutting the substrate in a similar procedure to the Example 1, the substrate surface was treated under the conditions shown in Table 9 by using the substrate surface treatment apparatus shown in FIG. 2.

Further thereafter, a deposited film made of an organic optical semiconductor was formed on the substrate and an electrophotographic photosensitive member was produced.

Satisfactory results were obtained in the image characteristics from the electrophotographic photosensitive member thus obtained as in the case of the amorphous silicon photosensitive member as compared with the case that the present invention was not used.

Example 6

Fifteen minutes later from completion of cutting the substrate in a similar procedure to the Example 1, the substrate surface was treated under the conditions shown in Table 9 by using the substrate surface treatment apparatus shown in FIG. 2.

Further thereafter, a deposited film made of selenium was formed on the substrate and an electrophotographic photosensitive member was produced.

Satisfactory results were obtained in the image characteristics from the electrophotographic photosensitive member thus obtained as in the case of the amorphous silicon photosensitive member as compared with the case that the present invention was not used.

Clearly the electrophotographic photosensitive member produced according to the present invention is not limited to the configuration shown in FIGS. 6 and 7.

For example, in FIGS. 6 and 7, a surface layer 404 and a charge injection blocking layer 402 need not always to be provided and a photoconductive layer 403 can be formed in a multi-layer structure having, for example, a charge transport layer (CTL) and a charge generating layer (CGL) and not a one-layer structure.

A non-monocrystalline silicon (for example, a-SiGe, a-SiSn, etc.) which contains germanium or tin atoms and, as a base material, silicon atoms and a non-monocrystalline germanium (for example, a-Ge, etc.) which contains germanium atoms as the base material are available for an infrared ray absorbing layer 405. The infrared ray absorbing layer 405 further contains an element selected from the III group and the V group of the periodic table as a substance for controlling the conductivity. A non-monocrystal which contains silicon atoms as the base material and an element selected from the elements belonging to the III group or the V group of the periodic table as a substance for controlling the conductivity (for example, amorphous silicon (a-Si(III), a-Si(V) containing the III group or the V group of the periodic table) is preferable for a charge injection blocking layer 402. AS the above-described elements of the III group of the periodic table, boron (B), gallium (Ga) and indium (In) are preferably selected and particularly boron is more preferably selected. As the elements of the V group of the periodic,table, phosphor (P), arsenic (As), antimony (Sb) and bismuth (Bi) are preferably selected and particularly arsenic is more preferably selected.

For a charge injection blocking layer 402, a nonmonocrystalline material which contains at least one element selected from oxygen (O), nitrogen (N) and carbon (C) and silicon atoms as the base material can be preferably used.

For a photoconductive layer 403, a non-monocrystalline material (for example, a-Si) which contains silicon atoms as the base material can be preferably used and, in addition, can contain a substance for controlling the conductivity as described above (elements of the III and V groups of the periodic table) and at least one element selected from the group consisting of oxygen, nitrogen and carbon. It is preferable to reduce the contents of the elements of the III and V groups of the periodic table, oxygen, nitrogen and carbon to be contained to the quantities smaller than those necessary for generally making it function as the charge injection blocking layer 402.

For a surface layer 403, a non-monocrystalline material which contains silicon atoms as the base material and at least one element selected from a group consisting of oxygen (O), nitrogen (N) and carbon (C) can be preferably used.

All layers described above preferably contain hydrogen atoms and/or halogen atoms.

In addition, a substance for controlling the conductivity, oxygen, nitrogen, carbon, germanium and/or tin can be contained evenly in a plane parallel to the support and evenly or unevenly in a direction of the layer thickness.

The layer structure and the contents of elements can be appropriately determined in accordance with the characteristics of a desired electrophotographic photosensitive member.

As described above, in the manufacturing method for electrophotographic photosensitive members comprising a step for forming a functional film on the aluminum substrate, particularly in the manufacturing method for electrophotographic photosensitive members comprising a step for forming a non-monocrystalline deposited film comprising one or both of hydrogen atoms and fluorine atoms, and silicon atoms on the aluminum substrate by the plasma CVD method, according to the present invention, by carrying out cleaning of the surface of the substrate with water in which carbon dioxide has been dissolved before the deposited film is formed thereon, it is possible to economically and stably manufacture electrophotographic photosensitive members which provide even high quality images.

TABLE 1

| Treatment conditions | Precleaning | Cleaning | Drying |
|---|---|---|---|
| Treating agent: | Aqueous detergent solution | Aqueous carbon dioxide solution (conductivity: varied) | Air |
| Temperature: | 30° C. | 25° C. | 80° C. |
| Pressure: | — | — | 5 kg·f/cm$^2$ |
| Treating time: | 3 min | 1 min | 1 min |
| Others: | Ultrasonic treatment | | |

TABLE 2

| Film-forming conditions | Layer structure: Charge blocking layer (a-Si:H(B)) | Photoconductive layer (a-Si:H) | Surface layer (a-SiC) |
|---|---|---|---|
| Gas flow rate: | | | |
| $SiH_4$ | 350 sccm | 350 sccm | 70 sccm |
| He | 100 sccm | 100 sccm | 100 sccm |
| $CH_4$ | 0 sccm | 0 sccm | 350 sccm |
| $B_2H_6$ | 1,000 ppm | 0 ppm | 0 ppm |
| Pressure: | 10 mTorr | 10 mTorr | 12 mTorr |
| Microwave power: | 1,000 W | 1,000 W | 1,000 W |
| Bias voltage: | 100 V | 100 V | 100 V |
| Layer thickness: | 3 μm | 25 μm | 0.5 μm |

TABLE 3

| Conductivity (μS/cm) | Faulty image | Black spots | Electrophotographic performance | Environmental properties |
|---|---|---|---|---|
| Experiment 1: | | | | |
| 1 | C | A | 101% | A |
| 2 | B | A | 105% | A |
| 4 | A | A | 111% | A |
| 6 | AA | A | 119% | A |
| 10 | AA | A | 121% | A |
| 15 | AA | A | 120% | A |
| 30 | AA | A | 121% | A |
| 35 | A | A | 115% | A |
| 40 | B | A | 109% | A |
| 50 | C | A | 104% | A |
| Comparative Experiment 1: | | | | |
| | A | C | 100% | C |
| Comparative Experiment 2: | | | | |
| | C | A | 100% | A |

TABLE 4

| | Cleaning |
|---|---|
| Treating agent: | Trichloroethane |
| Temperature: | 50° C. |
| Treating time: | 3 min |
| Others: | Ultrasonic treatment |

TABLE 5

| Treatment conditions | Precleaning | Cleaning | Drying |
|---|---|---|---|
| Treating agent: | Aqueous detergent solution | Pure water (resistivity: 10 MΩ·cm) | Air |
| Temperature: | 40° C. | 25° C. | 80° C. |
| Pressure: | | | 5 kg·f/cm$^2$ |
| Treating time: | 3 min | 1 min | 1 min |
| Others: | Ultrasonic treatment | | |

TABLE 6

| Treatment conditions | Precleaning | Cleaning | Drying |
|---|---|---|---|
| Treating agent: | Aqueous detergent solution | Aqueous carbon dioxide solution (conductivity: 20 μS/cm) | Air |
| Temperature: | 30° C. | 25° C. | 80° C. |
| Pressure: | | | 5 kg·f/cm$^2$ |
| Treating time: | 3 min | 1 min | 1 min |
| Others: | Ultrasonic treatment | | |

TABLE 7

| Si content | Faulty image |
|---|---|
| 0 ppm | B |
| 0.7 ppm | B |
| 1 ppm | A |
| 10 ppm | AA |
| 100 ppm | AA |
| 0.1 wt% | AA |
| 1 wt% | A |
| 1.5 wt% | C |

TABLE 8

| Resistivity (MΩ·cm) | Faulty image | Black spots | Cost | Environmental properties |
|---|---|---|---|---|
| Experiment 1: | | | | |
| 0.7 | B | C | AA | A |
| 1 | A | B | AA | A |
| 3 | AA | A | AA | A |
| 5 | AA | AA | AA | A |
| 13 | AA | AA | AA | A |
| 15 | AA | AA | A | A |
| 17 | A | AA | B | A |
| 18 | A | A | C | A |
| Comparative Experiment 1: | | | | |
| | A | C | B | C |
| Comparative Experiment 2: | | | | |
| | C | A | AA | A |

TABLE 9

| Treatment conditions | Precleaning | Cleaning | Drying |
|---|---|---|---|
| Treating agent: | Aqueous detergent solution | Aqueous carbon dioxide solution (conductivity: 15 μS/cm) | Air |
| Temperature: | 30° C. | 20° C. | 80° C. |
| Pressure: | | | 5 kg·f/cm$^2$ |
| Treating time: | 3 min | 2 min | 1 min |
| Others: | Ultrasonic treatment | | |

TABLE 10

| | Present invention | Comparative Example 1 | Comparative Example 2 |
|---|---|---|---|
| Faulty image: | AA | C | C |
| Black spots: | AA | C | A |
| Electrophotographic performance: | 120% | 100% | 100% |
| Environmental properties: | A | C | A |
| Uneven image: | AA | C | C |
| Fog: | AA | B | B |

TABLE 11

| Film-forming conditions | Layer structure: Charge blocking layer (a-Si:H(B)) | Photoconductive layer (a-Si:H) | Surface layer (a-SiC) |
|---|---|---|---|
| Gas flow rate: | | | |
| $SiH_4$ | 250 sccm | 350 sccm | 20 sccm |
| He | 250 sccm | 350 sccm | 100 sccm |
| $CH_4$ | 0 sccm | 0 sccm | 500 sccm |
| $B_2H_6$ | 1,000 ppm | 0 ppm | 0 ppm |
| Pressure: | 0.3 Torr | 0.5 Torr | 0.4 Torr |
| RF power: | 300 W | 400 W | 300 W |
| Layer thickness: | 3 μm | 25 μm | 0.5 μm |

TABLE 12

| Treatment conditions | Cleaning | Drying |
|---|---|---|
| Treating agent: | Pure water (resistivity: 10 MΩ·cm) | Nitrogen gas |
| Temperature: | 50° C. | 40° C. |
| Pressure: | | 5 kg·f/cm$^2$ |
| Treating time: | 1 min | 1 min |

TABLE 13

| Film-forming conditions | Layer structure: Charge blocking layer (a-Si:H(B)) | Charge transport layer (a-SiC:H) | Charge generation layer (a-Si:H) | Surface layer (a-SiC:H) |
|---|---|---|---|---|
| Gas flow rate: | | | | |
| $SiH_4$ | 350 sccm | 350 sccm | 350 sccm | 70 sccm |
| He | 100 sccm | 100 sccm | 100 sccm | 100 sccm |
| $CH_4$ | 35 sccm | 35 sccm | 0 sccm | 350 sccm |
| $B_2H_6$ | 1,000 ppm | 0 ppm | 0 ppm | 0 ppm |
| Pressure: | 11 mtorr | 11 mtorr | 10 mtorr | 12 mtorr |
| Microwave power: | 1,000 W | 1,000 W | 1,000 W | 1,000 W |
| Bias voltage: | 100 V | 100 V | 100 V | 100 V |
| Layer thickness: | 3 μm | 20 μm | 5 μm | 0.5 μm |

TABLE 14

| Treatment conditions | Pre-cleaning | Cleaning | Drying |
|---|---|---|---|
| Treating agent: | Aqueous detergent solution | Aqueous carbon dioxide solution (conductivity: 20 μS/cm) | Aqueous carbon dioxide solution (conductivity: 20 μS/cm) |
| Temp.: | 30° C. | 25° C. | 50° C. |
| Treating time: | 3 min | 1 min | 2 min |
| Others: | Ultrasonic treatment | Ultrasonic treatment | |

What is claimed is:

1. A method for manufacturing an electrophotographic photosensitive member comprising: dissolving sufficient carbon dioxide in water for cleaning to provide a conductivity from 2 μS/cm to 40 μS/cm; cleaning surface of an aluminum substrate with the carbon dioxide-dissolved water and forming a functional film on the cleaned aluminum substrate.

2. The method according to claim 1, wherein a pH value of said water in which carbon dioxide is dissolved is from 3.8 to 6.0.

3. The method according to claim 1, wherein said water in which carbon dioxide is dissolved is made up by dissolving carbon dioxide in pure water having a resistivity of 1 MΩ.cm.

4. The method according to claim 1, wherein said step for forming the functional film on the aluminum substrate comprises a step for forming a nonmonocrystalline deposited film comprising silicon atoms and one or both of hydrogen atoms and fluorine atoms, on the aluminum substrate by the plasma CVD method.

5. The method according to claim 1, wherein said aluminum substrate is an aluminum substrate containing at least a fine quantity of silicon atoms.

6. The method according to claim 5, wherein said aluminum substrate is an aluminum substrate containing at least silicon atoms of 1 ppm to 1 weight %.

7. The method according to claim 1, wherein said water in which carbon dioxide is dissolved has a resistivity of from 1 MΩ.cm to 17 MΩ.cm at a water temperature of 25° C., and contains 10000 pieces or less of fine grains of 0.2 μm or more in diameter per milliliter, 100 microbes or less in the total number per milliliter and 10 mg or less of organic substances per milliliter.

8. The method according to claim 1, wherein a temperature of said water in which carbon dioxide is dissolved is from 10° C. to 90° C.

9. The method according to claim 1, wherein the cleaning with said water in which carbon dioxide is dissolved is carried out by dipping.

10. The method according to claim 1, wherein the cleaning with said water in which carbon dioxide is dissolved is carried out by blowing.

11. The method according to claim 10, wherein a water pressure of said blowing is from 2 kg.f/cm$^2$ to 300 kg.f/cm$^2$.

12. The method according to claim 10, wherein a quantity of water for said blowing is from 1 l/min. to 200 l/min.

13. The method according to claim 10, wherein a temperature of said water in which carbon dioxide is dissolved is from 5° C. to 90° C.

14. The method according to claim 1, wherein a time of cleaning with said water in which carbon dioxide is dissolved is from 10 seconds to 30 minutes.

15. The method according to claim 1, wherein a precleaning step is provided before the cleaning with said water in which carbon dioxide is dissolved.

16. The method according to claim 1, wherein said water in which carbon dioxide is dissolved contains carbon dioxide at 60% or less of a saturated quantity.

17. The method according to claim 15, wherein said cleaning step is carried out using water.

18. The method according to claim 17, wherein said water has a surface active agent.

19. The method according to claim 17, wherein said water has a resistivity of from 1 MΩ.cm to 17 MΩ.cm at a water temperature of 25° C., and contains 10000 pieces or less of fine grains of 0.2 μm or more in diameter per milliliter, 100 microbes or less in the total number per milliliter and 10 mg or less of organic substances per milliliter.

20. The method according to claim 17, wherein a temperature of said water is from 10° C. to 90° C.

21. The method according to claim 18, wherein said surface active agent is at least one surface active agent selected from a group consisting of an anionic surface active agent, a cationic surface active agent, a non-ionic surface active agent and an amphoteric surface active agent.

22. The method according to claim 15, wherein said cleaning step further uses ultrasonic waves.

23. The method according to claim 22, wherein said ultrasonic waves have a frequency of from 100 Hz to 10 MHz.

24. The method according to claim 22, wherein said ultrasonic waves have an output of from 0.1 W/liter to 1 KW/liter.

25. The method according to claim 1, wherein a substrate cutting step is provided before said cleaning step with water in which carbon dioxide is dissolved.

26. The method according to claim 25, wherein a time from said cutting step to said cleaning step with water in which carbon dioxide is dissolved is from one minute to 16 hours.

27. The method according to claim 1, wherein the substrate is fed into a deposited film forming apparatus for forming said functional film within a time of from one minute to 8 hours after said cleaning step with water in which carbon dioxide is dissolved.

28. The method according to claim 1, wherein a drying step is provided after said cleaning step with water in which carbon dioxide is dissolved.

29. The method according to claim 28, wherein a drying of the drying step is selected from hot air drying, vacuum drying or hot water drying.

30. The method according to claim 28, wherein said drying step is carried out by using hot water in which carbon dioxide is dissolved.

31. The method according to claim 30, wherein said hot water has a temperature of from 30° C. to 90° C.

32. The method according to claim 30, wherein said hot water in which carbon dioxide is dissolved is a water which has a resistivity of from 1 MfΩ.cm to 17 MΩ.cm at a water temperature of 25° C., and contains 10000 pieces or less of fine grains of 0.2 μm or more in diameter per milliliter, 100 microbes or less in the total number per milliliter and 10 mg or less of organic substances per milliliter.

33. The method according to claim 30, wherein said carbon dioxide is contained in water at 60% or less of saturated solubility.

34. The method according to claim 30, wherein said hot water has a conductivity of from 2 μS/cm to 40 μS/cm.

35. The method according to claim 30, wherein said hot water has a pH value of from 3.8 to 6.0.

36. The method according to claim 1, wherein said aluminum substrate comprises silicon atoms.

37. The method according to claim 37, wherein the content of said silicon atoms is from 1 weight ppm to 1 weight %.

38. The method according to claim 1, wherein said aluminum substrate comprises magnesium atoms.

39. The method according to claim 38, wherein the content of said magnesium atoms is from 0.1 weight to 10 weight %.

40. The method according to claim 1, wherein said functional film comprises a non-monocrystalline film comprising silicon.

41. The method according to claim 40, wherein said non-monocrystalline film comprises at least one material selected from amorphous silicon, amorphous germanium, amorphous germanium silicon or amorphous silicon carbide.

42. The method according to claim 1, wherein said functional film comprises a photoconductive layer.

43. The method according to claim 42, wherein said functional film further comprises at least one layer selected from a group consisting of a surface layer, a charge injection blocking layer and a long wavelength absorbing layer.

44. The method according to claim 1, wherein said functional film is formed by an RF plasma CVD method or a microwave plasma CVD method.

45. The method according to claim 1, wherein said functional film has a thickness of from 5 μm to 100 μm.

46. The method according to claim 44, wherein said functional deposited film is formed under a pressure of from 0.5 m Torr to 100 m Torr.

47. The method according to claim 44, wherein said functional film is formed at a substrate temperature of from 100° C. to 500° C.

48. An electrophotographic photosensitive member comprising: a functional film on an aluminum substrate wherein the surface of the substrate is cleaned with water obtained by dissolving sufficient carbon dioxide in water for cleaning to provide a conductivity from 2 μS/cm to 40 μS/cm.

49. The member according to claim 48, wherein a pH value of said water in which carbon dioxide is dissolved is from 3.8 to 6.0.

50. The member according to claim 48, wherein said water in which carbon dioxide is dissolved is a water prepared by dissolving carbon dioxide in pure water having a resistivity of 1 MΩ.cm or more.

51. The member according to claim 48, wherein a step for forming said functional film on said aluminum substrate comprises a step for forming a nonmonocrystalline deposited film which comprises silicon atoms and one or both of hydrogen atoms and fluorine atoms on the aluminum substrate by a plasma CVD method.

52. The member according to claim 48, wherein said aluminum substrate contains at least a fine amount of silicon atoms.

53. The member according to claim 52, wherein said aluminum substrate contains at least silicon atoms in a range of from 1 ppm to 1 weight %.

54. The member according to claim 48, wherein said water in which carbon dioxide is dissolved has a resistivity of from 1 MΩ.cm to 17 MΩ.cm at a water temperature of 25° C., and contains 10000 pieces or less of fine grains of 0.2 μm or more in diameter per milliliter, 100 microbes or less in the total number per milliliter and 10 mg or less of organic substances per milliliter.

55. The member according to claim 48, wherein a temperature of said water in which carbon dioxide is dissolved is from 10° C. to 90° C.

56. The member according to claim 48, wherein the cleaning with said water in which carbon dioxide is dissolved is carried out by dipping.

57. The member according to claim 48, wherein the cleaning with said water in which carbon dioxide is dissolved is carried out by blowing.

58. The member according to claim 57, wherein a pressure of water for said blowing is from 2 kg.f/cm$^2$ to 300 kg.f/cm$^2$.

59. The member according to claim 57, wherein a quantity of water for said blowing is from 1 l/min. to 200 l/min.

60. The member according to claim 57, wherein a temperature of said water in which carbon dioxide is dissolved is from 5° C. to 90° C.

61. The member according to claim 48, wherein a time of said cleaning with said water in which carbon dioxide is dissolved is from 10 seconds to 30 minutes.

62. The member according to claim 48, wherein a precleaning step is provided before said cleaning with said water in which carbon dioxide is dissolved.

63. The member according to claim 48, wherein said water in which carbon dioxide is dissolved contains carbon dioxide at 60% or less of a saturated quantity.

64. The member according to claim 62, wherein said precleaning step is carried out with water.

65. The member according to claim 64, wherein said water comprises a surface active agent.

66. The member according to claim 64, wherein said water has a resistivity of from 1 MΩ.cm to 17 MΩ.cm at a water temperature of 25° C., and contains 10000 pieces or less of fine grains of 0.2 μm or more in diameter per milliliter, 100 microbes or less in the total number per milliliter and 10 mg or less of organic substances per milliliter.

67. The member according to claim 64, wherein a temperature of said water is from 10° C. to 90° C.

68. The member according to claim 65, wherein said surface active agent is at least one surface active agent selected from a group consisting of an anionic surface active agent, a cationic surface active agent, a non-ionic surface active agent and an amphoteric surface active agent.

69. The member according to claim 62, wherein said precleaning step is carried out by using ultrasonic waves.

70. The member according to claim 69, wherein said ultrasonic waves have a frequency of from 100 kHz to 10 MHz.

71. The member according to claim 69, wherein said ultrasonic waves have an output of from 0.1 W/l to 1 kW/l.

72. The member according to claim 48, wherein a substrate cutting step is provided before said cleaning step with water in which carbon dioxide is dissolved.

73. The member according to claim 72, wherein a time from said cutting step to said cleaning step with water in which carbon dioxide is dissolved is from 1 minute to 16 hours.

74. The member according to claim 48, wherein said substrate is fed into a deposited film forming apparatus for forming said functional film within a time of from one minute to 8 hours after said cleaning step with water in which carbon dioxide is dissolved.

75. The member according to claim 48, wherein a drying step is provided after said cleaning step with water in which carbon dioxide is dissolved.

76. The member according to claim 75, wherein drying of said drying step is selected from hot air drying, vacuum drying or hot water drying.

77. The member according to claim 75, wherein said drying step is carried out by using hot water in which carbon dioxide is dissolved.

78. The member according to claim 77, wherein a temperature of said hot water is from 30° C. to 90° C.

79. The member according to claim 77, wherein said hot water in which carbon dioxide is dissolved is a water which has a resistivity of from 1 MΩ.cm to 7 MΩ.cm at a water temperature of 25° C., and contains 10000 pieces or less of fine grains of 0.2 μm or more in diameter per milliliter, 100 microbes or less in the total number per milliliter and 10 mg or less of organic substances per milliliter.

80. The member according to claim 77, wherein said hot water in which carbon dioxide is dissolved contains carbon dioxide as at 60% or less of a saturated quantity.

81. The member according to claim 77, wherein said hot water has a conductivity of from 2 μS/cm to 40 μS/cm.

82. The member according to claim 77, wherein said hot water has a pH value of from 3.8 to 6.0.

83. The member according to claim 48, wherein said aluminum substrate comprises silicon atoms.

84. The member according to claim 83, wherein the content of said silicon atoms is from 1 weight ppm to 1 weight %.

85. The member according to claim 48, wherein said aluminum substrate comprises magnesium atoms.

86. The member according to claim 85, wherein the content of said magnesium is from 0.1 weight % to 10 weight %.

87. The member according to claim 48, wherein said functional film comprises a non-monocrystalline film comprising silicon.

88. The member according to claim 87, wherein said non-monocrystalline film comprises at least one material selected from amorphous silicon, amorphous germanium, amorphous germanium silicon or amorphous silicon carbide.

89. The member according to claim 48, wherein said functional film comprises a photoconductive layer.

90. The member according to claim 89, wherein said functional film further comprises at least one layer selected from a group consisting of a surface layer, a charge injection blocking layer and a long wavelength absorbing layer.

91. The member according to claim 48, wherein said functional film is formed by the RF plasma CVD method or the microwave plasma CVD method.

92. The member according to claim 48, wherein a thickness of said functional film is from 5 μm to 100 μm.

* * * * *

UNITED STATES PATENT AND TRADEMARK OFFICE

CERTIFICATE OF CORRECTION

PATENT NO. : 5,480,754

DATED : January 2, 1996

INVENTORS : TETSUYA TAKEI ET AL.

It is certified that error appears in the above-identified patent and that said Letters Patent is hereby corrected as shown below:

IN THE DRAWINGS

Sheet 4 of 7: Fig. 5, "CIRCUT" should read --CIRCUIT--.

COLUMN 2

Line 20, "cleaning a" should read --cleaning an--.
Line 33, "use" should read --use on--.
Line 39, "nonmonocrystalline" should read --non-monocrystalline--.

COLUMN 3

Line 43, "chip" should read --chips--.

COLUMN 5

Line 28, "another" should be deleted.
Line 34, "another" should be deleted.

COLUMN 7

Line 11, "used" should read --use--.

UNITED STATES PATENT AND TRADEMARK OFFICE

CERTIFICATE OF CORRECTION

PATENT NO. : 5,480,754

DATED : January 2, 1996

INVENTORS : TETSUYA TAKEI ET AL.

It is certified that error appears in the above-identified patent and that said Letters Patent is hereby corrected as shown below:

COLUMN 8

Line 2, "of" should be deleted.
Line 47, "chip" should read --chips--.

COLUMN 10

Line 2, "electrode 212′" should read --electrode 212--.
Line 30, "0.2 Brp," should read --0.2 μm--.

COLUMN 11

Line 43, "foams" should read --foam--.

COLUMN 12

Line 54, "10" should be deleted.

COLUMN 13

Line 62, "foams" should read --foam--.

COLUMN 14

Line 54, "C1," should read --Cl,--.

UNITED STATES PATENT AND TRADEMARK OFFICE

CERTIFICATE OF CORRECTION

PATENT NO. : 5,480,754

DATED : January 2, 1996

INVENTORS : TETSUYA TAKEI ET AL.

It is certified that error appears in the above-identified patent and that said Letters Patent is hereby corrected as shown below:

COLUMN 15

Line 41, "100m Tort" should read --100m Torr--.

COLUMN 19

Line 12, "n,lmber" should read --number--.
Line 55, "After" should read --¶ After--.
Line 61, "chip" should read --chips--.

COLUMN 20

Line 42, "20 BS/cm" should read --20 μS/cm--.
Line 59, "weight" should read --weight %--.

COLUMN 21

Line 1, "10" should be deleted.

COLUMN 22

Line 57, "ordinary" should read --original--.

COLUMN 25

Line 53, "conductivity.A" should read --conductivity.
¶ A--.

UNITED STATES PATENT AND TRADEMARK OFFICE

CERTIFICATE OF CORRECTION

PATENT NO. : 5,480,754

DATED : January 2, 1996

INVENTORS : TETSUYA TAKEI ET AL.

It is certified that error appears in the above-identified patent and that said Letters Patent is hereby corrected as shown below:

Column 23

Line 53, "electrophotographicphotosensitive" should read --electrophotographic photosensitive--.

COLUMN 26

Line 2, "nonmonoc-" should read --non-monocrystalline--.
Line 3, "rystalline" should be deleted.

COLUMN 30

Line 19, "surface" should read --a surface--.
Line 31, "nonmonocrystalline" should read --non-monocrystalline--.

COLUMN 31

Line 11, "cleaning" should read --precleaning--.
Line 28, "cleaning" should read --precleaning--.
Line 60, "1mfΩ.cm" should read --1MΩ.cm--.

COLUMN 32

Line 7, "claim 37," should read --claim 36,--.
Line 13, "weight" should read --weight %--.
Line 53, "nonmonocrystalline" should read --non-monocrystalline--.

UNITED STATES PATENT AND TRADEMARK OFFICE

CERTIFICATE OF CORRECTION

PATENT NO. : 5,480,754

DATED : January 2, 1996

INVENTORS : TETSUYA TAKEI ET AL.

It is certified that error appears in the above-identified patent and that said Letters Patent is hereby corrected as shown below:

COLUMN 34

Line 19, "7MΩ.cm" should read --17MΩcm--.
Line 26, "as" should be deleted.

Signed and Sealed this

Twenty-first Day of May, 1996

Bruce Lehman

*Attest:*

BRUCE LEHMAN

*Attesting Officer*

*Commissioner of Patents and Trademarks*